US011385583B2

(12) United States Patent
Kitamura

(10) Patent No.: US 11,385,583 B2
(45) Date of Patent: Jul. 12, 2022

(54) IMAGE FORMING APPARATUS, IMAGE FORMING METHOD, AND IMAGE FORMING PROGRAM CAPABLE OF PREVENTING IMAGE QUALITY FROM BEING LOWERED

(71) Applicant: Konica Minolta, Inc., Tokyo (JP)

(72) Inventor: Kazuya Kitamura, Nagoya (JP)

(73) Assignee: Konica Minolta, Inc., Tokyo (JP)

( * ) Notice: Subject to any disclaimer, the term of this patent is extended or adjusted under 35 U.S.C. 154(b) by 0 days.

(21) Appl. No.: 17/353,955

(22) Filed: Jun. 22, 2021

(65) Prior Publication Data

US 2021/0405564 A1 Dec. 30, 2021

(30) Foreign Application Priority Data

Jun. 30, 2020 (JP) ..... JP2020-113417

(51) Int. Cl.
*G03G 15/00* (2006.01)
*G03G 15/16* (2006.01)
*G03G 21/00* (2006.01)

(52) U.S. Cl.
CPC ..... *G03G 15/5025* (2013.01); *G03G 15/5058* (2013.01); *G03G 21/0011* (2013.01)

(58) Field of Classification Search
CPC ..... G03G 15/161; G03G 15/5054; G03G 15/5058
USPC ..... 399/71, 101
See application file for complete search history.

(56) References Cited

U.S. PATENT DOCUMENTS 11,281,146 B1 * 3/2022 Tashiro ..... G03G 15/5058

FOREIGN PATENT DOCUMENTS

JP 2004-286985 10/2004

* cited by examiner

*Primary Examiner* — William J Royer
(74) *Attorney, Agent, or Firm* — BakerHostetler

(57) ABSTRACT

There is provided an image forming apparatus in which an image carrier and an elastic body may be in pressure contact with each other, and in which a toner remover may be in contact with the image carrier to remove toner remaining on the image carrier. The image forming apparatus may include: a first hardware processor that forms an image pattern in a region including at least a part of a pressure contact part of the image carrier that is in pressure contact with the elastic body when operation of the image carrier is stopped; a second hardware processor that acquires density of the image pattern formed on the image carrier; a third hardware processor that adjusts driving time of the image carrier based on the density of the image pattern; and a fourth hardware processor that drives the image carrier for the driving time.

13 Claims, 19 Drawing Sheets

| DENSITY DIFFERENCE ΔE | DRIVING TIME |
|---|---|
| ΔE ≤ ΔE0 | NONE |
| ΔE0 < ΔE ≤ ΔEa | Ta |
| ΔEa < ΔE ≤ ΔEb | Tb |

FIG. 16

| NUMBER OF PIECES OF PROCESSING OF SECONDARY TRANSFER ROLLER | REMOVAL PROCESSING |
|---|---|
| SMALLER THAN 10000 | EXECUTED |
| EQUAL TO OR LARGER THAN 10000 | NOT EXECUTED |

FIG. 19

| OPERATION STOP TIME OF INTERMEDIATE TRANSFER BELT | REMOVAL PROCESSING |
|---|---|
| SHORTER THAN 72 HOURS | NOT EXECUTED |
| EQUAL TO OR LONGER THAN 72 HOURS | EXECUTED |

FIG. 21

| NUMBER OF PIECES OF PROCESSING OF SECONDARY TRANSFER ROLLER | OPERATION STOP TIME OF INTERMEDIATE TRANSFER BELT | REMOVAL PROCESSING |
|---|---|---|
| SMALLER THAN 10000 | SHORTER THAN 72 HOURS | NOT EXECUTED |
| | EQUAL TO OR LONGER THAN 72 HOURS | EXECUTED |
| EQUAL TO OR LARGER THAN 10000 | SHORTER THAN 168 HOURS | NOT EXECUTED |
| | EQUAL TO OR LONGER THAN 168 HOURS | EXECUTED |

IMAGE FORMING APPARATUS, IMAGE FORMING METHOD, AND IMAGE FORMING PROGRAM CAPABLE OF PREVENTING IMAGE QUALITY FROM BEING LOWERED

CROSS REFERENCE TO RELATED APPLICATIONS

This application claims priority to Japanese Patent Application No. 2020-113417, filed on Jun. 30, 2020, which is incorporated herein by reference in its entirety.

BACKGROUND

Technological Field

The present disclosure relates to an image forming apparatus, an image forming method, and an image forming program, and more specifically to an image forming apparatus in which an elastic body is in pressure contact with an image carrier, and an image forming method and an image forming program executed in the image forming apparatus.

Description of the Related Art

In an image forming apparatus such as a Multi Function Peripheral (MFP), a toner image on an image carrier is transferred onto a recording medium such as paper to cause an image to be formed on the recording medium. The image carrier is provided so as to be in pressure contact with an elastic body such as a roller. Here, in a case in which the image carrier and the elastic body are left in a stopped state for a long time while being in pressure contact with each other, the surface of the image carrier may be contaminated by a substance (bleed) exuding from the elastic body. In this case, the transferability of the contaminated portion of the image carrier is lowered, and a white spot is thus generated in the formed image.

For example, JP 2004-286985 A describes an image forming apparatus at least including a photoconductor, a charging means that charges a surface of the photoconductor at uniform potential, a latent image forming means that forms an image-like electrostatic latent image on the surface of the photoconductor, a developing means that develops the electrostatic latent image by applying toner to the electrostatic latent image to form a toner image, an endless intermediate transfer belt that partially abuts on the surface of the photoconductor, a primary transfer means that transfers the toner image formed on the surface of the photoconductor to a peripheral surface of the intermediate transfer belt at a transfer position at which the photoconductor and the intermediate transfer belt abut on each other, and a second transfer means that transfers the toner image transferred on the peripheral surface of the intermediate transfer belt to a recording medium at a second transfer position different from the transfer position, and the image forming apparatus includes a toner intervening arranging means that arranges the toner so that the toner intervenes at the transfer position at the end of operation of the apparatus.

JP 2004-286985 A describes that, since, at the end of operation of the apparatus, the toner is arranged so that the toner intervenes between the photoconductor and the intermediate transfer belt that abut on each other at the transfer position, the photoconductor and the intermediate transfer belt are not in close contact with each other, and contamination of the surface of the photoconductor due to a bleed substance such as a plasticizer is suppressed. However, in a case in which the number of the bleed substances generated is large, the toner in contact with the bleed substances is contaminated, and the bleed substances as well as the toner adhere to the photoconductor. In this case, the surface of the photoconductor is rather contaminated, and the quality of the image formed on the recording medium is lowered.

SUMMARY

The present disclosure has been made to solve one or more of the above-mentioned problems, and an object of the present disclosure may be to provide an image forming apparatus that can prevent the quality of an image formed on a recording medium from being lowered.

Another object of the present disclosure may be to provide an image forming method that can prevent the quality of an image formed on a recording medium from being lowered.

Still another object of the present disclosure may be to provide an image forming program that can prevent the quality of an image formed on a recording medium from being lowered.

To achieve at least one of the abovementioned objects, according to an aspect of the present disclosure, there is provided an image forming apparatus in which an image carrier and an elastic body may be in pressure contact with each other, and in which a toner remover may be in contact with the image carrier to remove toner remaining on the image carrier. The image forming apparatus reflecting one aspect of the present disclosure may comprise: a first hardware processor that forms an image pattern in a region including at least a part of a pressure contact part of the image carrier that is in pressure contact with the elastic body when operation of the image carrier is stopped; a second hardware processor that acquires density of the image pattern formed on the image carrier by the first hardware processor; a third hardware processor that adjusts driving time of the image carrier based on the density of the image pattern acquired by the second hardware processor; and a fourth hardware processor that drives the image carrier for the driving time adjusted by the third hardware processor at a stage before an image is formed on a recording medium.

BRIEF DESCRIPTION OF THE DRAWINGS

The advantages and features provided by one or more embodiments of the disclosure will become more fully understood from the detailed description given hereinbelow and the appended drawings which are given by way of illustration only, and thus are not intended as a definition of the limits of the present disclosure:

FIG. 16 is a table illustrating a relationship between the number of pieces of processing of a secondary transfer roller and removal processing according to a third modification example;

FIG. 19 is a table illustrating a relationship between operation stop time of the intermediate transfer belt and the removal processing in a fourth modification example;

FIG. 21 is a table illustrating a relationship among the number of pieces of processing of the secondary transfer roller, the operation stop time of the intermediate transfer belt, and the removal processing;

DETAILED DESCRIPTION OF EMBODIMENTS

Hereinafter, an image forming apparatus according to one or more embodiments of the present disclosure will be described with reference to the drawings. However, the scope of the disclosure is not limited to the disclosed embodiments. In the following description, identical parts are labeled with the same reference signs. Names and functions of these parts are the same. Therefore, detailed description thereof will not be repeated. Also, in the following description, an MFP will be described as an example of the image forming apparatus. Further, in the MFP described below, a recording medium on which an image is formed includes paper such as plain paper, high-quality paper, recycled paper, and photographic paper, and an OverHead Projector (OHP) film.

First Embodiment

Figure 1:
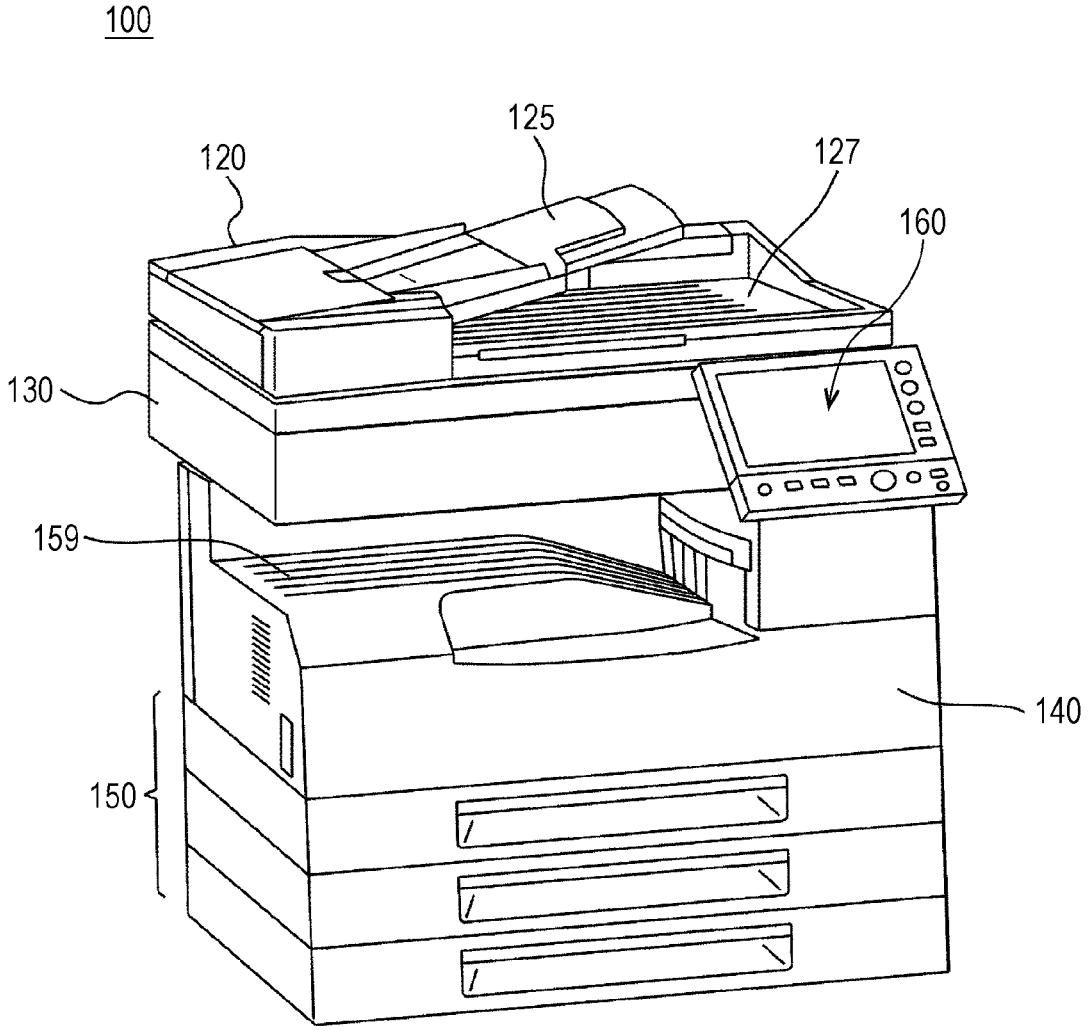
FIG. 1 is a perspective view illustrating appearance of an MFP according to an embodiment.
Figure 2:
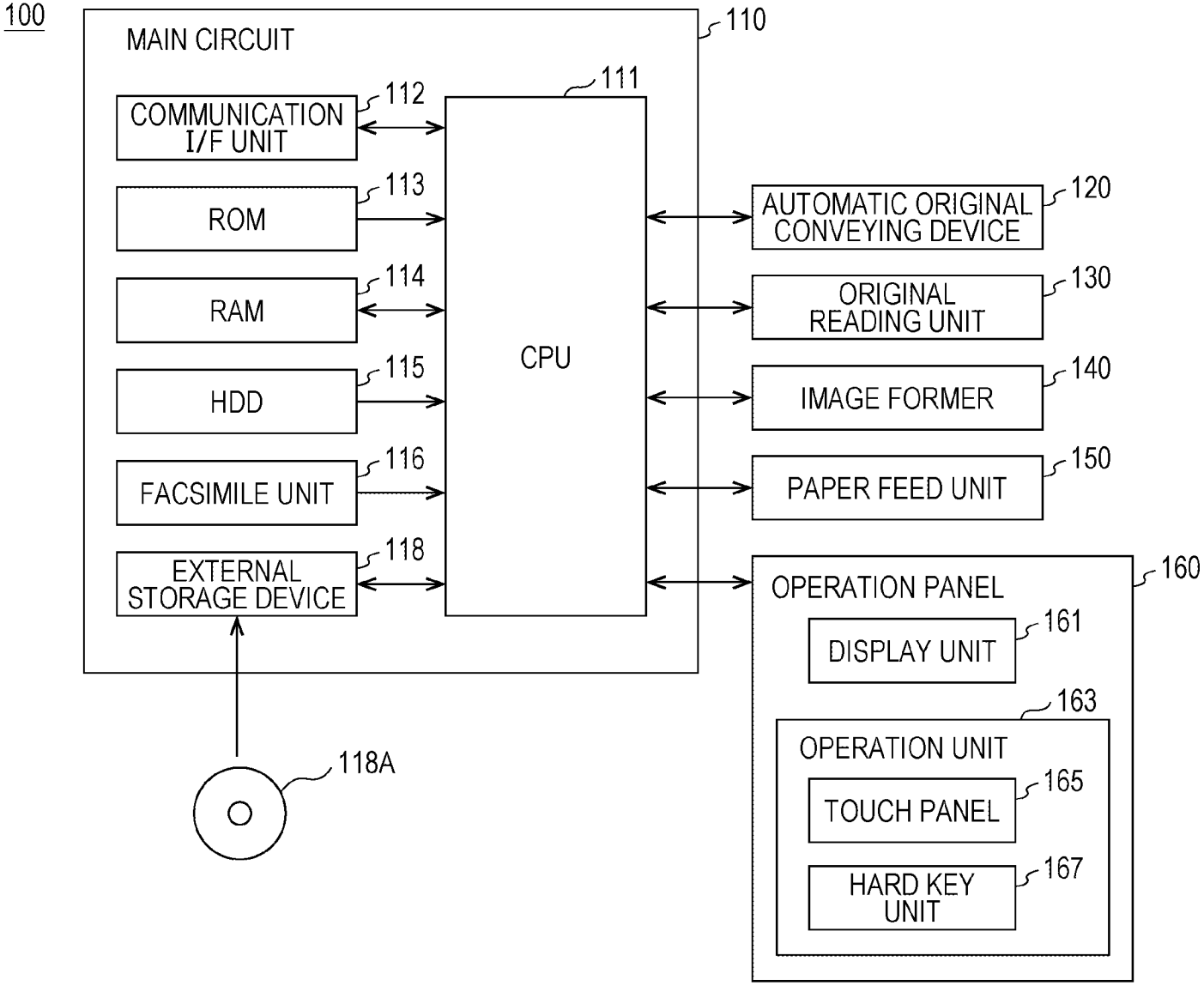
FIG. 2 is a block diagram illustrating an overview of a hardware configuration of the MFP.

FIG. 1 is a perspective view illustrating appearance of an MFP according to the present embodiment. FIG. 2 is a block diagram illustrating an overview of a hardware configuration of the MFP. Referring to FIGS. 1 and 2, an MFP 100 is an example of an image forming apparatus and includes a main circuit 110, an original reading unit 130 that reads an original, an automatic original conveying device 120 that conveys the original to the original reading unit 130, an image former 140 that forms an image on a recording medium based on image data, a paper feed unit 150 that supplies the recording medium to the image former 140, and an operation panel 160 that serves as a user interface.

The automatic original conveying device 120 automatically conveys a plurality of originals set on an original tray 125 one by one to an original reading position of the original reading unit 130 and discharges onto an original discharge tray 127 the original from which an image formed on the original is read by the original reading unit 130. The automatic original conveying device 120 includes an original detection sensor that detects originals placed on the original tray 125.

The original reading unit 130 includes a rectangular reading surface for reading an original. The reading surface is made of platen glass, for example. The automatic original conveying device 120 is connected to a main body of the MFP 100 to be rotatable about an axis parallel to one side of the reading surface and can be opened and closed. The original reading unit 130 is arranged on a lower side of the automatic original conveying device 120, and the reading surface of the original reading unit 130 is exposed in an open state in which the automatic original conveying device 120 is rotated and opened. Therefore, the user can place the original over the reading surface of the original reading unit 130. The state of the automatic original conveying device 120 can be changed into the open state in which the reading surface of the original reading unit 130 is exposed or a closed state in which the reading surface is covered. The automatic original conveying device 120 includes a state detection sensor that detects the open state of the automatic original conveying device 120.

The original reading unit 130 includes a light source that emits light and a photoelectric conversion element that receives light and scans an image formed on the original placed on the reading surface. In a case in which the original is placed in a reading region, light emitted from the light source is reflected by the original, and the reflected light is imaged by the photoelectric conversion element. When the photoelectric conversion element receives the light reflected by the original, the photoelectric conversion element generates image data obtained by converting the received light into an electric signal. The original reading unit 130 outputs the image data to a Central Processing Unit (CPU) 111 included in the main circuit 110.

The paper feed unit 150 takes out a recording medium housed in any of a plurality of paper feed trays or a manual feed tray and conveys the recording medium to the image former 140.

The image former 140 is controlled by the CPU 111 and forms an image on the recording medium conveyed by the paper feed unit 150 by a known electrophotographic method. In the present embodiment, the image former 140 forms an image of the image data input from the CPU 111 on the recording medium conveyed by the paper feed unit 150. The recording medium on which the image is formed is discharged to a paper discharge tray 159. The image data output by the CPU 111 to the image former 140 includes image data input from the original reading unit 130 and image data received from an outside such as print data.

The main circuit 110 includes the CPU 111 that controls the entire MFP 100, a communication interface (I/F) unit 112, Read Only Memory (ROM) 113, Random Access Memory (RAM) 114, a hard disc drive (HDD) 115 serving as a large-capacity storage device, a facsimile unit 116, and an external storage device 118. The CPU 111 is connected to the automatic original conveying device 120, the original reading unit 130, the image former 140, the paper feed unit 150, and the operation panel 160 and controls the entire MFP 100.

The ROM 113 stores a program executed by the CPU 111 or data required to execute the program. The RAM 114 is used as a work area when the CPU 111 executes a program. Also, the RAM 114 temporarily stores image data continuously transmitted from the original reading unit 130.

The operation panel 160 is provided on the top of the MFP 100. The operation panel 160 includes a display unit 161 and an operation unit 163. The display unit 161 is a liquid crystal display (LCD), for example, and displays an instruction menu to the user, information about acquired image data, and the like. Note that the LCD can be replaced with any device that displays an image such as an organic electroluminescence (EL) display.

The operation unit 163 includes a touch panel 165 and a hard key unit 167. The touch panel 165 is of a capacitive type. Note that the touch panel 165 can be of another type such as a resistive type, a surface acoustic wave type, an infrared type, and an electromagnetic resonance type instead of the capacitive type.

The touch panel 165 is provided on the display unit 161 with a detection surface thereof superposed on the upper surface or the lower surface of the display unit 161. Here, the size of the detection surface of the touch panel 165 and the size of the display surface of the display unit 161 are the same. Therefore, the coordinate system of the display surface and the coordinate system of the detection surface are the same. The touch panel 165 detects on the detection surface a position on the display surface of the display unit 161 that the user indicates and outputs the coordinates of the detected position to the CPU 111. Since the coordinate system of the display surface and the coordinate system of the detection surface are the same, the coordinates output by the touch panel 165 can be replaced with the coordinates on the display surface.

The hard key unit 167 includes a plurality of hard keys. An example of the hard keys is a contact switch. The touch panel 165 detects a position on the display surface of the display unit 161 indicated by the user. Since the user operates the MFP 100 with an upright posture in many cases, the display surface of the display unit 161, the operation surface of the touch panel 165, and the hard key unit 167 are arranged facing upward. The reason for this is that the user can easily visually recognize the display surface of the display unit 161 and can easily indicate the operation unit 163 with a finger.

The communication I/F unit 112 is an interface for connecting the MFP 100 to a network. The communication I/F unit 112 communicates with another computer or a data processing device connected to the network by means of a communication protocol such as Transmission Control Protocol (TCP) and File Transfer Protocol (FTP). Note that the network to which the communication I/F unit 112 is connected is a local area network (LAN), and the connection form may be wired or wireless. The network is not limited to the LAN and may be a wide area network (WAN), a public switched telephone network (PSTN), the Internet, or the like.

The facsimile unit 116 is connected to the public switched telephone network (PSTN) and transmits facsimile data to the PSTN or receives facsimile data from the PSTN. The facsimile unit 116 stores received facsimile data in the HDD 115, converts the facsimile data into print data that can be printed in the image former 140, and outputs the print data to the image former 140. As a result, the image former 140 forms an image of the facsimile data received from the facsimile unit 116 on paper. The facsimile unit 116 also converts data stored in the HDD 115 into facsimile data and transmits the facsimile data to a facsimile device connected to the PSTN.

The external storage device 118 is controlled by the CPU 111 and causes Compact Disc Read Only Memory (CD-ROM) 118A or semiconductor memory to be mounted therein. In the present embodiment, although an example in which the CPU 111 executes a program stored in the ROM 113 will be described, the CPU 111 may control the external storage device 118, read a program to be executed by the CPU 111 from the CD-ROM 118A, store the read program in the RAM 114, and execute the program.

Note that the recording medium that stores the program to be executed by the CPU 111 is not limited to the CD-ROM 118A and may be a medium such as a flexible disc, a cassette tape, an optical disc (Magnetic Optical Disc (MO), Mini Disc (MD), or Digital Versatile Disc (DVD)), an IC card, an optical card, mask ROM, and semiconductor memory such as Erasable Programmable ROM (EPROM). Further, the CPU 111 may download a program from a computer connected to the network and store the program in the HDD 115 or cause the computer connected to the network to write the program in the HDD 115 and load onto the RAM 114 and execute the program stored in the HDD 115. The program referred to here includes not only a program that can directly be executed by the CPU 111 but also a source program, a compressed program, an encrypted program, and the like.

Figure 3:
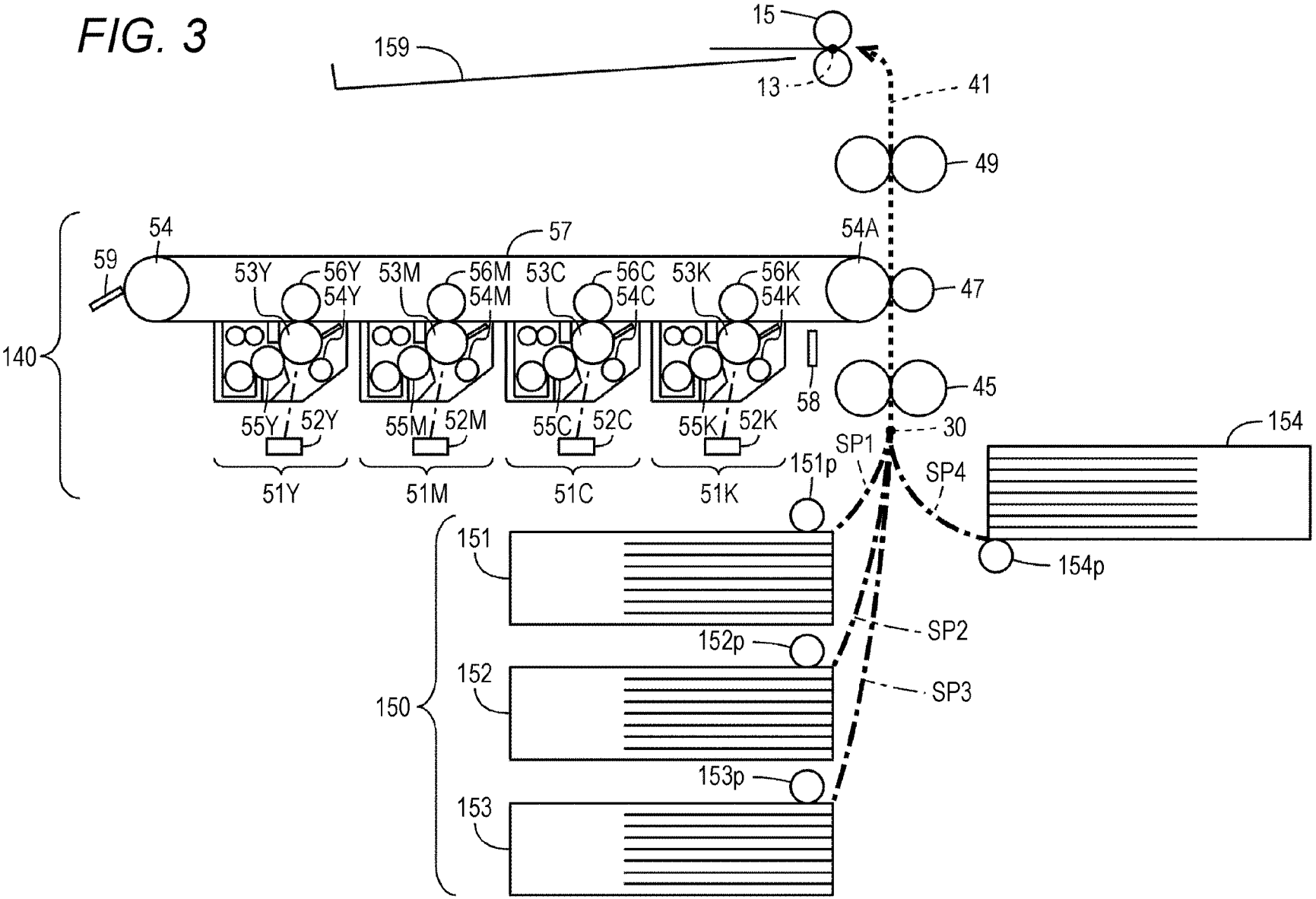
FIG. 3 is a schematic side view illustrating a partial internal configuration of an image former and a paper feed unit.

FIG. 3 is a schematic side view illustrating a partial internal configuration of the image former and the paper feed unit. Referring to FIG. 3, inside the MFP 100, a main conveyance path 41 indicated by the thick dotted arrow is formed so as to extend basically in an up-down direction. The main conveyance path 41 is a path for guiding paper conveyed from the paper feed unit 150 through the image former 140 to the paper discharge tray 159. In the main conveyance path 41 in the present example, a lower end 30 on the opposite side of an upper end 13 located further on the upper side than the image former 140 constitutes a carry-in port that receives paper from the paper feed unit 150. Also, the upper end 13 of the main conveyance path 41 constitutes a discharge port that discharges the paper on which an image has been formed to the paper discharge tray 159. The upper end 13 of the main conveyance path 41 is provided with a paper discharge roller 15.

The paper feed unit 150 includes three paper feed trays 151, 152, and 153 and a manual feed tray 154. The three paper feed trays 151, 152, and 153 are stacked so as to be arranged from the upper side to the lower side in this order. The manual feed tray 154 is provided on a sidewall of the MFP 100 and is located further on the lower side than the image former 140. As illustrated by the thick dashed-dotted lines in FIG. 3, the paper feed trays 151, 152, and 153 and the manual feed tray 154 are connected to the lower end 30 of the main conveyance path 41 through sub conveyance paths SP1, SP2, SP3, and SP4, respectively.

Pickup rollers 151*p*, 152*p*, 153*p*, and 154*p* are provided corresponding to the paper feed trays 151, 152, and 153 and the manual feed tray 154, respectively. Since operations of taking out the recording media from the paper feed trays 151, 152, and 153 and the manual feed tray 154 and conveying the recording media are the same, an operation of the paper feed tray 151 will be described here as an example.

In the paper feed tray 151, one or more recording media are stored in a stacked state. The paper feed tray 151 has a lift-up mechanism that pushes up one or more recording media housed therein. The pickup roller 151*p* is biased by an elastic member such as a spring so as to abut from above on the uppermost recording medium out of one or more recording media housed in the paper feed tray 151. The pickup roller 151*p* presses from above the recording medium. As the pickup roller 151*p* rotates, the uppermost recording medium is fed to the sub conveyance path SP1 due to a frictional force with the recording medium. The recording medium fed to the sub conveyance path SP1 is supplied to the main conveyance path 41.

In the MFP 100, at the time of image formation, a tray that houses a recording medium to be image-formed is selected as a target tray from the three paper feed trays 151, 152, and 153 and the manual feed tray 154. The pickup roller and the paper feed roller corresponding to the tray selected as the target tray from among the three paper feed trays 151, 152, and 153 and the manual feed tray 154 are operated to cause the recording medium to be supplied from the tray selected as the target tray through any of the sub conveyance paths SP1, SP2, SP3, and SP4 to the main conveyance path 41.

The image former 140 employs an intermediate transfer method and includes image forming units 51Y, 51M, 51C, and 51K for yellow, magenta, cyan, and black, respectively. At least one of the image forming units 51Y, 51M, 51C, and 51K is driven to cause an image to be formed on the recording medium. All of the image forming units 51Y, 51M, 51C, and 51K are driven to cause a full-color image to be formed. The image forming units 51Y, 51M, 51C, and 51K are provided with printing data of yellow, magenta, cyan, and black, respectively. Since the image forming units 51Y, 51M, 51C, and 51K differ only in the colors of the toners they handle, the image forming unit 51Y for forming a yellow image will be described here.

The image forming unit 51Y includes an exposure head 52Y into which yellow printing data is input, a photoconductor drum 53Y serving as an example of an image carrier, a charging roller 54Y, a developing roller 55Y, and a primary transfer roller 56Y. The exposure head 52Y emits laser light corresponding to the received printing data (electric signal). The emitted laser light is one-dimensionally scanned by a polygon mirror included in the exposure head 52Y and exposes the photoconductor drum 53Y. The one-dimensional scanning direction for the photoconductor drum 53Y is a main scanning direction. The charging roller 54Y is an elastic body and is arranged so as to be in pressure contact with the photoconductor drum 53Y. The photoconductor drum 53Y is charged by the charging roller 54Y and then irradiated with the laser light emitted by the exposure head 52Y. As a result, an electrostatic latent image is formed on the photoconductor drum 53Y. Subsequently, the developing roller 55Y places toner on the electrostatic latent image to form a toner image. The toner image formed on the photoconductor drum 53Y is transferred onto an intermediate transfer belt 57 (image carrier) by the primary transfer roller 56Y.

Similarly, the image forming unit 51M includes an exposure head 52M into which magenta printing data is input, a photoconductor drum 53M, a charging roller 54M, a developing roller 55M, and a primary transfer roller 56M. The image forming unit 51C includes an exposure head 52C into which cyan printing data is input, a photoconductor drum 53C, a charging roller 54C, a developing roller 55C, and a primary transfer roller 56C. The image forming unit 51K includes an exposure head 52K into which black printing data is input, a photoconductor drum 53K, a charging roller 54K, a developing roller 55K, and a primary transfer roller 56K.

The intermediate transfer belt 57 is an example of an image carrier and is suspended by a driving roller 54 and a roller 54A so as not to be loosened. When the driving roller 54 is rotated counterclockwise in the drawing, the intermediate transfer belt 57 is rotated counterclockwise in the drawing at predetermined speed. As the intermediate transfer belt 57 is rotated, the roller 54A is rotated counterclockwise.

As a result, the image forming units 51Y, 51M, 51C, and 51K sequentially transfer toner images onto the carrying surface of the intermediate transfer belt 57. The intermediate transfer belt 57 carries the toner images transferred on the carrying surface. A time at which each of the image forming units 51Y, 51M, 51C, and 51K transfers the toner image onto the intermediate transfer belt 57 is adjusted by detecting a reference mark attached to the intermediate transfer belt 57. As a result, yellow, magenta, cyan, and black toner images are superposed on the intermediate transfer belt 57.

Also, the image former 140 includes an Image Density Control (IDC) sensor 58. The IDC sensor 58 is a light intensity sensor including a reflective photo sensor, for example, and detects a toner image formed on the intermediate transfer belt 57 by detecting the intensity of the reflected light from the surface of the intermediate transfer belt 57. The detection result output by the IDC sensor 58 is used for image stabilization processing. The image stabilization processing is processing for determining a control value for use in control of the image former 140. Specifically, the image stabilization processing is processing for causing the image former 140 to form a patch image determined in advance on the intermediate transfer belt 57 and determining a control value based on a measurement result obtained by measuring the density of the patch image. The control value includes voltage applied to the charging rollers 54Y, 54M, 54C, and 54K, bias voltage applied to the developing rollers 55Y, 55M, 55C, and 55K, primary transfer voltage applied to the primary transfer rollers 56Y, 56M, 56C, and 56K, and secondary transfer voltage applied to a secondary transfer roller 47.

Further, the image former 140 includes a cleaning blade 59. The cleaning blade 59 is made of a urethane-rubber-based elastic body, for example, and is arranged to enable the intermediate transfer belt 57 to be rubbed. The cleaning blade 59 cleans the intermediate transfer belt 57 by scraping off the toner image remaining on the intermediate transfer belt 57 as the intermediate transfer belt 57 is rotated.

On the main conveyance path 41, a timing roller 45, the secondary transfer roller 47, and a fixing roller 49 are arranged to be spaced from each other in this order from the lower end 30 to the upper end 13. The secondary transfer roller 47 is made of an elastic body such as foam rubber and is in pressure contact with the roller 54A with the intermediate transfer belt 57 interposed therebetween. Note that, in the present example, the MFP 100 does not have a pressure contact separation mechanism for switching between a pressure contact state and a separation state of the intermediate transfer belt 57 and the secondary transfer roller 47. Therefore, the cost of the MFP 100 can be reduced, and the size thereof can be reduced. A recording medium supplied from the paper feed unit 150 to the main conveyance path 41 is sent to the timing roller 45.

The timing roller 45 adjusts a conveying state of the recording medium on the main conveyance path 41 so that the recording medium reaches a position between the roller 54A and the secondary transfer roller 47 at a time when the toner image formed on the intermediate transfer belt 57 reaches the position between the roller 54A and the secondary transfer roller 47. The recording medium conveyed by the timing roller 45 is pressed against the intermediate transfer belt 57 by the secondary transfer roller 47, and by charging the secondary transfer roller 47, a yellow, magenta, cyan, or black toner image superposed and formed on the intermediate transfer belt 57 is transferred to the recording medium. The voltage applied to the secondary transfer roller 47 is controlled by the CPU 111 so that the charge amount of the secondary transfer roller 47 has a value suitable for the basis weight of the recording medium.

The recording medium on which the toner image is transferred is conveyed to the fixing roller 49 and heated by the fixing roller 49. As a result, the toner is melted and fixed on the recording medium. Thereafter, the recording medium on which the image has been formed is discharged from the upper end 13 of the main conveyance path 41 onto the paper discharge tray 159 by the paper discharge roller 15. The temperature of the fixing roller 49 is controlled by the CPU 111 so as to have a value suitable for the basis weight of the recording medium.

Figure 4:
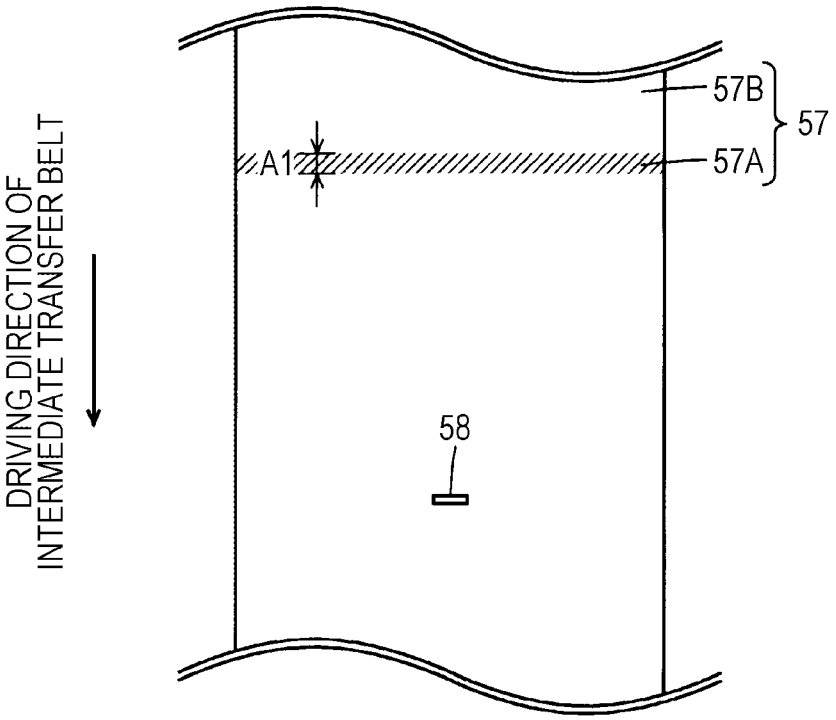
FIG. 4 is a diagram illustrating a part of an intermediate transfer belt.

FIG. 4 is a diagram illustrating a part of the intermediate transfer belt. Referring to FIG. 4, a surface portion of the intermediate transfer belt 57 that is in pressure contact with the secondary transfer roller 47 when the operation of the intermediate transfer belt 57 is stopped is referred to as a pressure contact part 57A. A surface portion of the intermediate transfer belt 57 that is not in pressure contact with the secondary transfer roller 47 when the operation of the intermediate transfer belt 57 is stopped, that is, a portion on the surface of the intermediate transfer belt 57 other than the pressure contact part 57A is referred to as a non-pressure contact part 57B. In FIG. 4 and the subsequent figures, the pressure contact part 57A of the intermediate transfer belt 57 is illustrated by a hatched pattern, and the non-pressure contact part 57B is illustrated in white. In a case in which the operation stop time of the intermediate transfer belt 57 is long, the pressure contact part 57A may be contaminated by a substance (bleed) exuding from the secondary transfer roller 47.

In particular, in a case in which the secondary transfer roller 47 is made of foam rubber containing various additives as in the present example, the bleed is likely to be generated, and the degree of contamination of the pressure contact part 57A thus increases. Also, in order to ensure the transferability of the toner image from the intermediate transfer belt 57 to the recording medium, the intermediate transfer belt 57 and the secondary transfer roller 47 may be strongly pressed against each other. The stronger the force by which the intermediate transfer belt 57 and the secondary transfer roller 47 are pressed, the longer the pressure contact width (nip width). The nip width is a length of the pressure contact part 57A in a driving direction of the intermediate transfer belt 57. In this case, the degree of contamination of the pressure contact part 57A tends to increase. Note that, in the present example, the nip width is A1.

Since the surface properties of the pressure contact part 57A contaminated by the bleed change, the transfer rate on the pressure contact part 57A is different from the transfer rate on the non-pressure contact part 57B. Therefore, in a case in which the exposure amounts are equal, a difference occurs between the amount of toner transferred to the pressure contact part 57A and that transferred to the non-pressure contact part 57B. Therefore, a difference occurs between the density of the toner image formed on the pressure contact part 57A and that on the non-pressure contact part 57B. The higher the degree of contamination of the pressure contact part 57A due to the bleed, the greater the difference between the density of the toner image on the pressure contact part 57A and that on the non-pressure contact part 57B.

Figure 5:
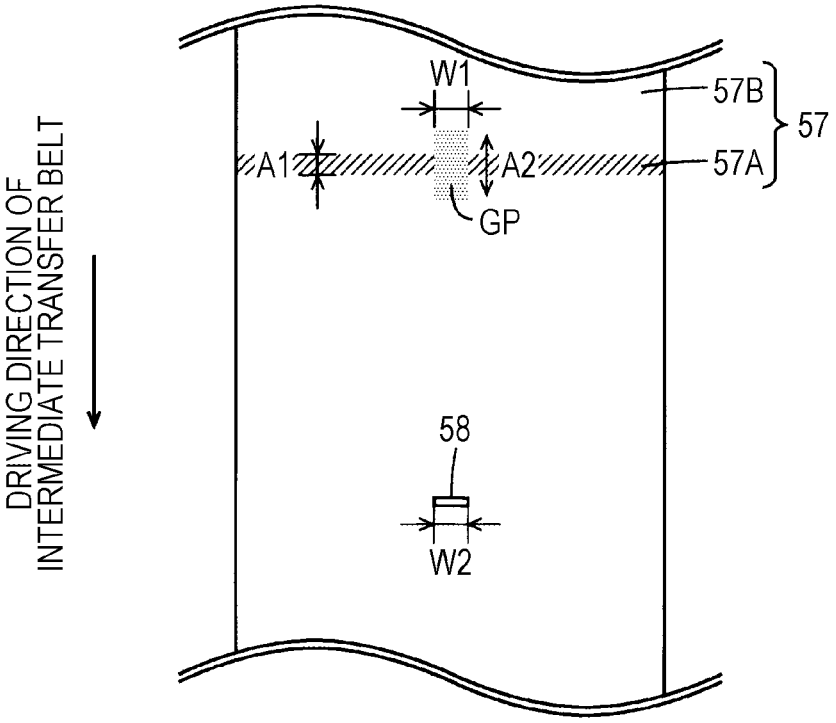
FIG. 5 is a diagram illustrating an example of a process for forming an image pattern.

FIG. 5 is a diagram illustrating an example of a process for forming an image pattern. In order to prevent the above phenomenon, referring to FIG. 5, before forming the toner image to be formed on the recording medium, an image pattern GP is formed in a region including at least a part of the pressure contact part 57A and at least a part of the non-pressure contact part 57B of the intermediate transfer belt 57. The image pattern GP is a toner image formed on the intermediate transfer belt 57 with the exposure amounts of the photoconductor drums 53Y, 53M, 53C, and 53K equal and is different from the toner image to be formed on the recording medium. In FIG. 5 and the subsequent figures, the image pattern GP is illustrated as a dot pattern.

Figure 6:
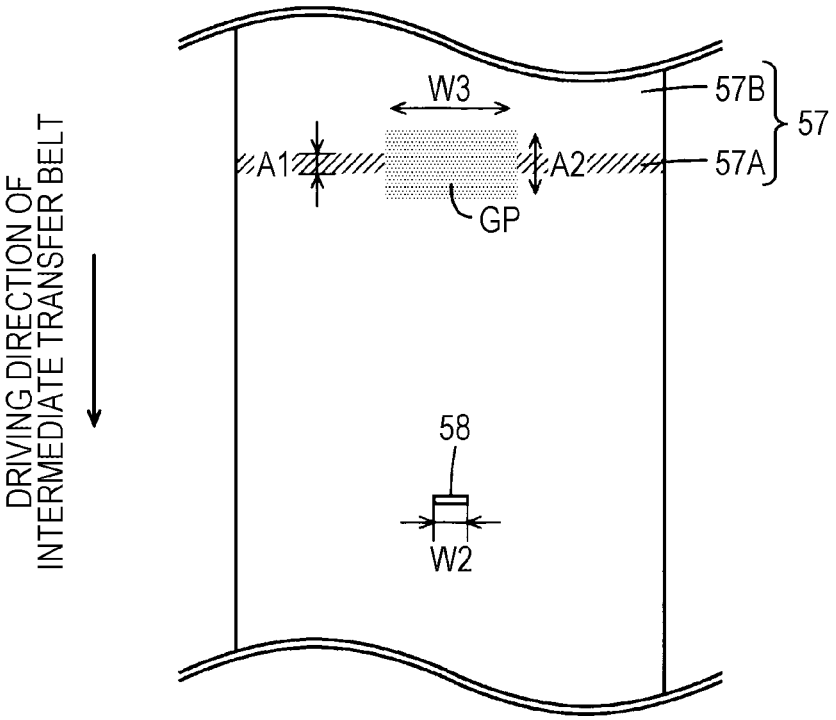
FIG. 6 is a diagram illustrating another example of the process for forming an image pattern.

In the present example, the width of the image pattern GP in the driving direction of the intermediate transfer belt 57 is A2, which is longer than the nip width A1. Also, in the present example, the width of the image pattern GP formed in the direction perpendicular to the driving direction of the intermediate transfer belt 57 is W1, which is approximately equal to W2, which is the width of a detection region detected by the IDC sensor 58, and the embodiment is not limited to this. FIG. 6 is a diagram illustrating another example of the process for forming an image pattern. Referring to FIG. 6, the width of the image pattern GP formed is W3 and may be longer than the width W2, which is the detection region detected by the IDC sensor 58.

Figure 7:
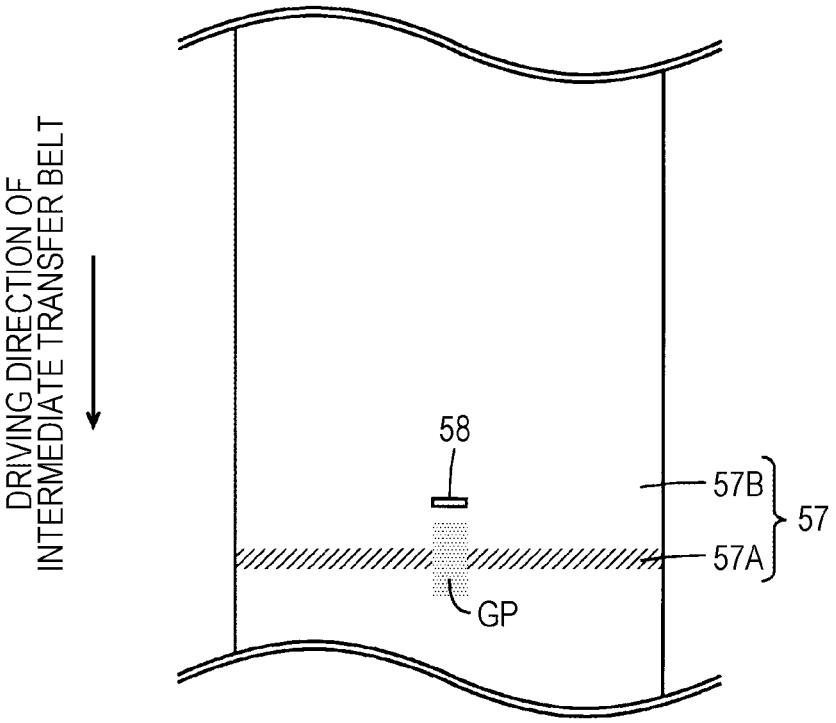
FIG. 7 is a diagram illustrating a process for detecting an image pattern.

FIG. 7 is a diagram illustrating a process for detecting an image pattern. Referring to FIG. 7, the intermediate transfer belt 57 is driven (rotated) so that the portion in which the image pattern GP is formed passes through the detection region detected by the IDC sensor 58. Thereafter, the image pattern GP is detected by the IDC sensor 58.

Figure 8:
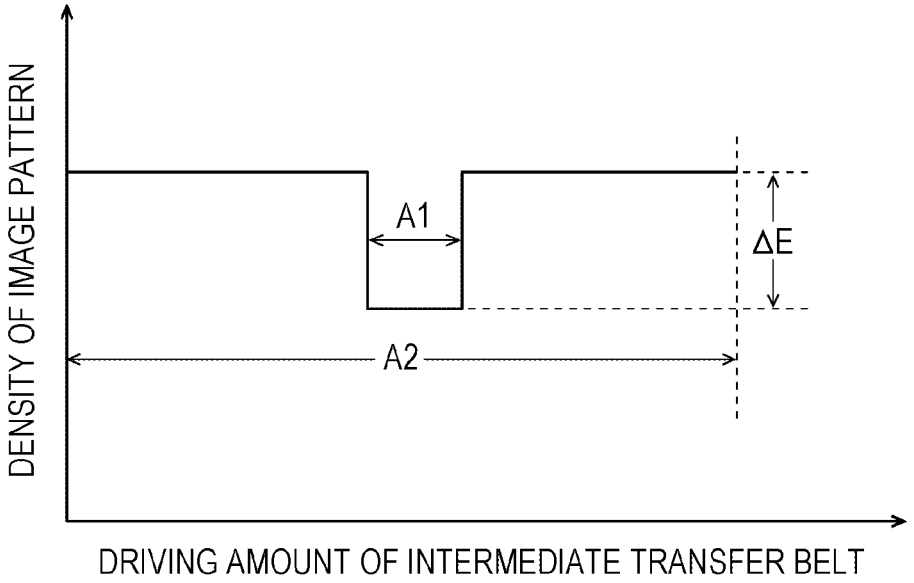
FIG. 8 is a graph illustrating distribution of density of the detected image pattern.

FIG. 8 is a graph illustrating the distribution of the density of the detected image pattern. Referring to FIG. 8, in a case in which the degree of contamination of the pressure contact part 57A is high, the amount of toner in the image pattern GP in the pressure contact part 57A is smaller than the amount of toner in the image pattern GP in the non-pressure contact part 57B. Therefore, the density of the image pattern GP in the pressure contact part 57A is lower than the density of the image pattern GP in the non-pressure contact part 57B. Accordingly, the density of the image pattern GP in the pressure contact part 57A and that in the non-pressure contact part 57B are detected, and a density difference ΔE of the image pattern GP between the portions is acquired.

Figure 9:
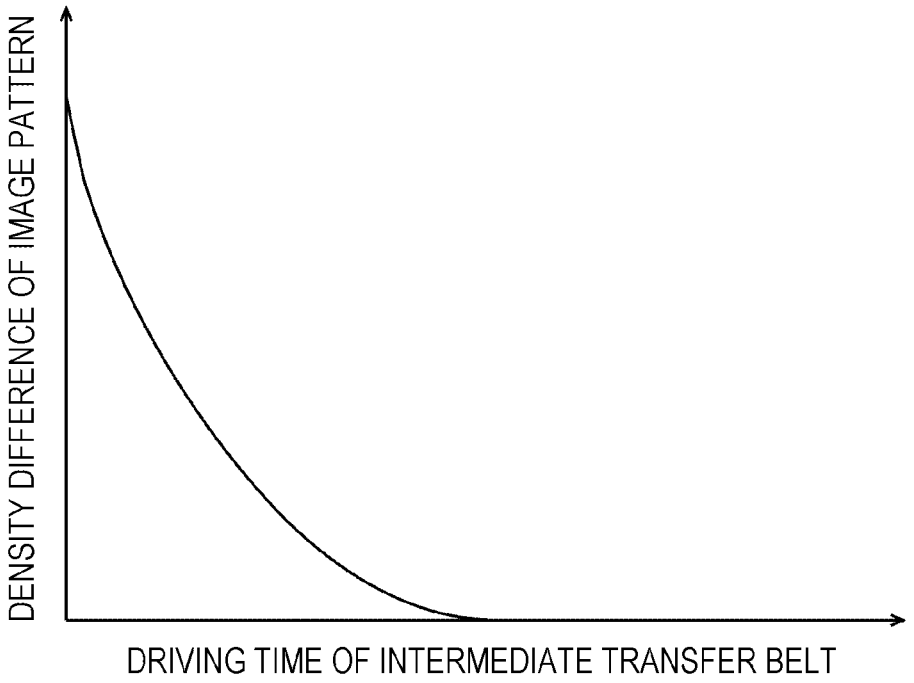
FIG. 9 is a graph illustrating a relationship between a density difference of the image pattern and driving time of the intermediate transfer belt.

The acquired density difference ΔE is compared with a predetermined density threshold value. The density threshold value is a value obtained by experiments in consideration of the influence of contamination of the intermediate transfer belt 57 due to the bleed on the image quality. In a case in which the density difference ΔE is lower than the density threshold value, it is determined that the pressure contact part 57A is not contaminated. On the other hand, in a case in which the density difference ΔE is equal to or higher than the density threshold value, it is determined that the pressure contact part 57A is contaminated, and the intermediate transfer belt 57 is driven for a predetermined time before forming an image on the recording medium. During this period, the bleed adhering to the pressure contact part 57A is gradually removed by rubbing with the cleaning blade 59. This can prevent the quality of the image formed on the recording medium from being lowered. FIG. 9 is a graph illustrating the relationship between the density difference of the image pattern and the driving time of the intermediate transfer belt. Referring to FIG. 9, as the driving time of the intermediate transfer belt 57 is longer, the amount of bleed to be removed is larger, and the density difference ΔE of the image pattern GP formed on the intermediate transfer belt 57 is thus lowered.

Figure 10:
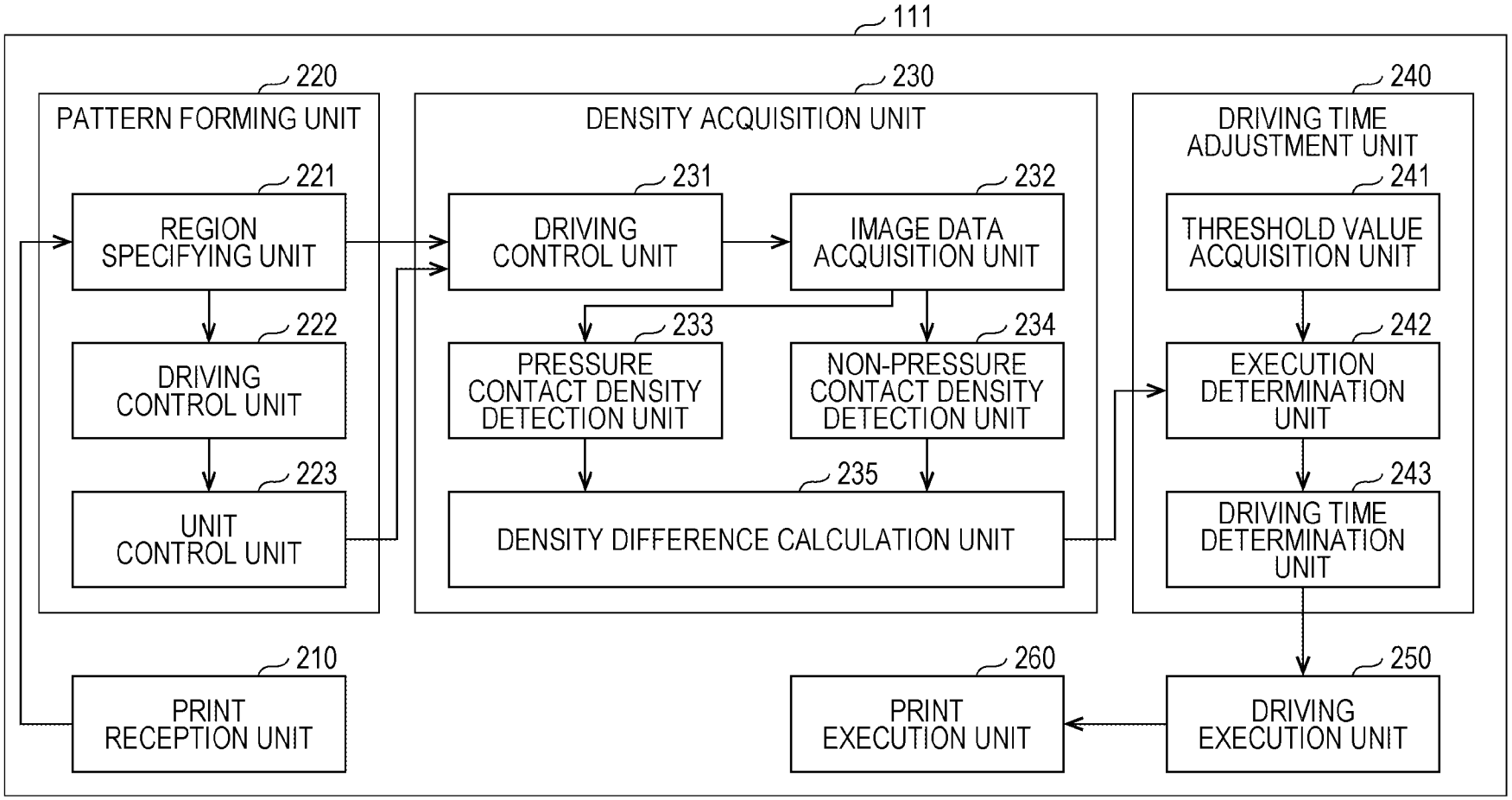
FIG. 10 is a diagram illustrating an example of functions of a CPU in the MFP according to the present embodiment.

FIG. 10 is a diagram illustrating an example of the functions of the CPU in the MFP according to the present embodiment. The functions illustrated in FIG. 10 are functions fulfilled by the CPU 111 included in the MFP 100 as the CPU 111 executes a recording medium conveying program stored in the ROM 113, the HDD 115, or the CD-ROM 118A. Referring to FIG. 10, the CPU 111 includes a print reception unit 210, a pattern forming unit 220, a density acquisition unit 230, a driving time adjustment unit 240, a driving execution unit 250, and a print execution unit 260. The print reception unit 210 receives an instruction to execute print from the user.

The pattern forming unit 220 forms the image pattern GP in a region including at least a part of the pressure contact part 57A and at least a part of the non-pressure contact part 57B of the intermediate transfer belt 57 before execution of print.

Specifically, the pattern forming unit 220 includes a region specifying unit 221, a driving control unit 222, and a unit control unit 223. The region specifying unit 221 specifies a region in which the image pattern GP is to be formed including at least a part of the pressure contact part 57A and at least a part of the non-pressure contact part 57B in response to the print reception unit 210 receiving the instruction to execute print. The region in which the image pattern GP is to be formed preferably bridges over the pressure contact part 57A in the front-rear direction in the driving direction of the intermediate transfer belt 57. In this case, the density difference of the image pattern GP between the pressure contact part 57A and the non-pressure contact part 57B can be obtained easily since, in a case in which the pressure contact part 57A is contaminated, the density of the image pattern GP in the pressure contact part 57A and that in the non-pressure contact part 57B located at the front and rear of the pressure contact part 57A will differ significantly in a later process.

The driving control unit 222 controls the operation of the intermediate transfer belt 57 so that the region specified by the region specifying unit 221 moves to an image forming region for any image forming unit (hereinbelow referred to as an image pattern forming unit) out of the image forming units 51Y, 51M, 51C, and 51K. In a case in which the intermediate transfer belt 57 is provided with a reference mark such as a position detection mark in advance, the operation of the intermediate transfer belt 57 may be controlled based on the reference mark. Alternatively, since a positional relationship between the secondary transfer roller 47 and the image pattern forming unit is known, the operation of the intermediate transfer belt 57 may be controlled based on the positional relationship.

The unit control unit 223 controls the operation of the image pattern forming unit to cause the image pattern GP to be formed in the region specified by the region specifying unit 221. The image pattern GP is preferably formed with relatively low density. As a result, in a later process, the density difference of the image pattern GP can be obtained more easily than in a case in which the image pattern GP is formed with maximum density (solid density) or relatively high density.

The image pattern GP is preferably formed in a region in which at least a part of the pressure contact part 57A and at least a part of the non-pressure contact part 57B are continuous. According to this configuration, in a case in which the pressure contact part 57A is contaminated, the density of the image pattern GP differs significantly at a boundary portion between the pressure contact part 57A and the non-pressure contact part 57B. Therefore, the density difference of the image pattern GP between the pressure contact part 57A and the non-pressure contact part 57B can be obtained easily. However, the image pattern GP may be formed in each of at least a part of the pressure contact part 57A and at least a part of the non-pressure contact part 57B. In this case, the region in at least the part of the pressure contact part 57A and the region in at least the part of the non-pressure contact part 57B may be separated from each other.

The density acquisition unit 230 acquires the density distribution of the image pattern GP formed by the pattern forming unit 220. Specifically, the density acquisition unit 230 includes a driving control unit 231, an image data acquisition unit 232, a pressure contact density detection unit 233, a non-pressure contact density detection unit 234, and a density difference calculation unit 235. After the image pattern GP is formed by the unit control unit 223, the driving control unit 231 controls the operation of the intermediate transfer belt 57 so that the region of the image pattern GP specified by the region specifying unit 221 passes through the detection region detected by the IDC sensor 58. In a case in which the intermediate transfer belt 57 is provided with a reference mark such as a position detection mark in advance, the operation of the intermediate transfer belt 57 may be controlled based on the reference mark. Alternatively, since a positional relationship between the image pattern forming unit and the IDC sensor 58 is known, the operation of the intermediate transfer belt 57 may be controlled based on the positional relationship.

The region of the image pattern GP passes through the detection region detected by the IDC sensor 58 to cause the image pattern GP to be detected by the IDC sensor 58, and image data indicating the image of the image pattern GP is generated. The image data acquisition unit 232 acquires the image data of the image pattern GP from the IDC sensor 58. In the present example, the image pattern GP is detected by the IDC sensor 58 for image stabilization processing, but the embodiment is not limited to this. The image pattern GP may be detected by a sensor provided separately from the IDC sensor 58. In this case, the image data acquisition unit 232 acquires the image data of the image pattern GP from the sensor.

The pressure contact density detection unit 233 detects the density of the image pattern GP in the pressure contact part 57A based on the image data acquired by the image data acquisition unit 232. The density of the image pattern GP in the pressure contact part 57A is detected as an average value of the density in a portion in the image data over the width A1 in which the density is low, for example.

The non-pressure contact density detection unit 234 detects the density of the image pattern GP in the non-pressure contact part 57B based on the image data acquired by the image data acquisition unit 232. The density of the image pattern GP in the non-pressure contact part 57B is detected as an average value of the density in the image data except the density portion over the width A1, for example. The density difference calculation unit 235 calculates a difference between the density detected by the pressure contact density detection unit 233 and the density detected by the non-pressure contact density detection unit 234. As a result, the density difference ΔE of the image pattern GP is acquired.

Note that the density of the image pattern GP in the pressure contact part 57A may be detected as minimum density of the image pattern GP, and the density of the image pattern GP in the non-pressure contact part 57B may be detected as maximum density of the image pattern GP. In this case, since it is not necessary to distinguish between the portion corresponding to the pressure contact part 57A and the portion corresponding to the non-pressure contact part 57B in the image pattern GP, the density difference ΔE of the image pattern GP can be obtained easily.

The driving time adjustment unit 240 adjusts the driving time of the intermediate transfer belt 57 based on the density difference ΔE acquired by the density acquisition unit 230. Specifically, the driving time adjustment unit 240 includes a threshold value acquisition unit 241, an execution determination unit 242, and a driving time determination unit 243. The threshold value acquisition unit 241 acquires a density threshold value stored in advance in the HDD 115 or the like.

The execution determination unit 242 compares the density difference ΔE calculated by the density difference calculation unit 235 with the density threshold value acquired by the threshold value acquisition unit 241 and determines whether or not to drive the intermediate transfer belt 57 based on the comparison result. In a case in which the density difference ΔE is lower than the density threshold value, it is determined that the intermediate transfer belt 57 is not to be driven. In a case in which the density difference ΔE is equal to or higher than the density threshold value, it is determined that the intermediate transfer belt 57 is to be driven.

In a case in which it is determined by the execution determination unit 242 that the intermediate transfer belt 57 is not to be driven, the driving time determination unit 243 sets the driving time of the intermediate transfer belt 57 to 0. In a case in which it is determined by the execution determination unit 242 that the intermediate transfer belt 57 is to be driven, the driving time determination unit 243 sets the driving time of the intermediate transfer belt 57 to a predetermined time T. Note that T is a value higher than 0. As a result, the driving time of the intermediate transfer belt 57 is adjusted.

The driving execution unit 250 controls the operation of the intermediate transfer belt 57 at a stage before the image is formed on the recording medium by the print execution unit 260 to execute driving of the intermediate transfer belt 57 for the driving time adjusted by the driving time adjustment unit 240. Specifically, in a case in which the driving time of the intermediate transfer belt 57 is set to 0 by the driving time determination unit 243, the driving execution unit 250 does not execute driving of the intermediate transfer belt 57. In a case in which the driving time of the intermediate transfer belt 57 is set to T by the driving time determination unit 243, the driving execution unit 250 executes driving of the intermediate transfer belt 57 for the driving time T. As a result, the bleed adhering to the pressure contact part 57A can be removed by the cleaning blade 59.

The driving execution unit 250 may further control the image former 140 so that the toner is transferred to the intermediate transfer belt 57 at the time of executing driving of the intermediate transfer belt 57. In this case, the lubricity between the cleaning blade 59 and the intermediate transfer belt 57 is improved to enable the cleaning blade 59 to be prevented from being rolled up or worn. In addition, the bleed can efficiently be removed by a composition such as an abrasive contained in the toner. Note that a similar effect can be obtained in a case in which a sufficiently large image pattern GP is formed on the intermediate transfer belt 57 as in the example in FIG. 6.

The print execution unit 260 executes print on the recording medium by controlling the image former 140 and the paper feed unit 150 after the driving execution unit 250 executes driving of the intermediate transfer belt 57.

Figure 11:
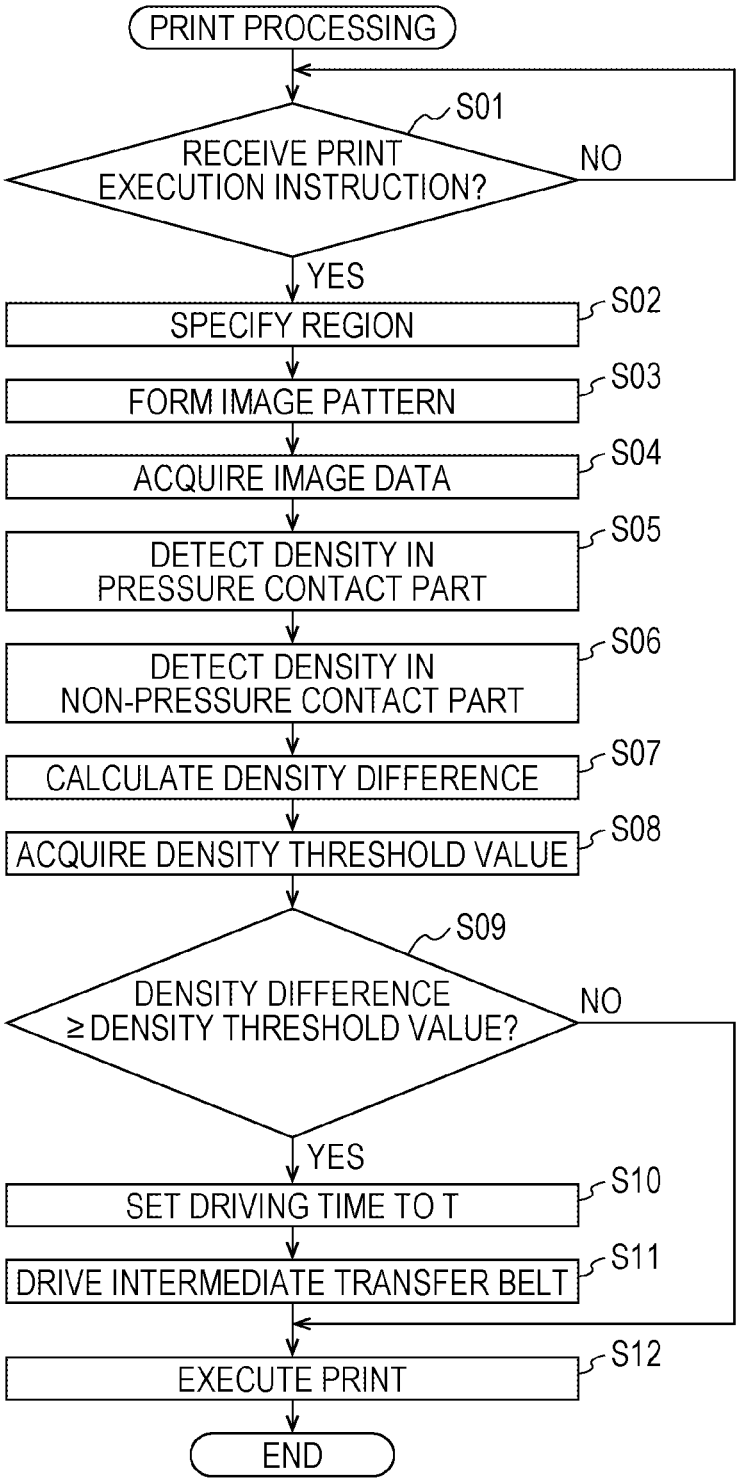
FIG. 11 is a flowchart illustrating an example of a flow of print processing.

FIG. 11 is a flowchart illustrating an example of a flow of print processing. The print processing is processing executed by the CPU 111 included in the MFP 100 as the CPU 111 executes a print processing program. Referring to FIG. 11, the CPU 111 included in the MFP 100 determines whether or not a print execution instruction has been received (step S01). A standby state is continued until the print execution instruction is received (NO in step S01), and in a case in which the print execution instruction is received (YES in step S01), the processing proceeds to step S02.

In step S02, a region including at least a part of the pressure contact part 57A and at least a part of the non-pressure contact part 57B of the intermediate transfer belt 57 is specified as a region in which the image pattern GP is to be formed, and the processing proceeds to step S03. In step S03, the image pattern GP is formed in the specified region by the image pattern forming unit, and the processing proceeds to step S04. In step S04, image data of the image pattern GP is acquired from the IDC sensor 58, and the processing proceeds to step S05.

In step S05, the density of the image pattern GP in the pressure contact part 57A is detected based on the image data, and the processing proceeds to step S06. In step S06, the density of the image pattern GP in the non-pressure contact part 57B is detected based on the image data, and the processing proceeds to step S07. In step S07, the density difference ΔE of the image pattern GP between the pressure contact part 57A and the non-pressure contact part 57B is calculated, and the processing proceeds to step S08.

In step S08, a density threshold value is acquired, and the processing proceeds to step S09. In step S09, it is determined whether or not the density difference ΔE of the image pattern GP is equal to or higher than the density threshold value. In a case in which the density difference ΔE of the image pattern GP is equal to or higher than the density threshold value, the processing proceeds to step S10, and otherwise, the processing proceeds to step S12.

In step S10, the driving time of the intermediate transfer belt 57 is set to T, and the processing proceeds to step S11. In step S11, the intermediate transfer belt 57 is driven for the set driving time T, and the processing proceeds to step S12. In step S12, print is executed in accordance with the print execution instruction, and the print processing ends.

First Modification Example

In a case in which the degree of contamination of the pressure contact part 57A is low, that is, in a case in which the density difference ΔE of the image pattern GP is low, the driving time of the intermediate transfer belt 57 is preferably short. On the other hand, in a case in which the degree of contamination of the pressure contact part 57A is high, that is, in a case in which the density difference ΔE of the image pattern GP is high, the driving time of the intermediate transfer belt 57 is preferably long. Therefore, the driving time of the intermediate transfer belt 57 may be determined in accordance with the magnitude of the density difference ΔE of the image pattern GP.

Figures 12, 13:
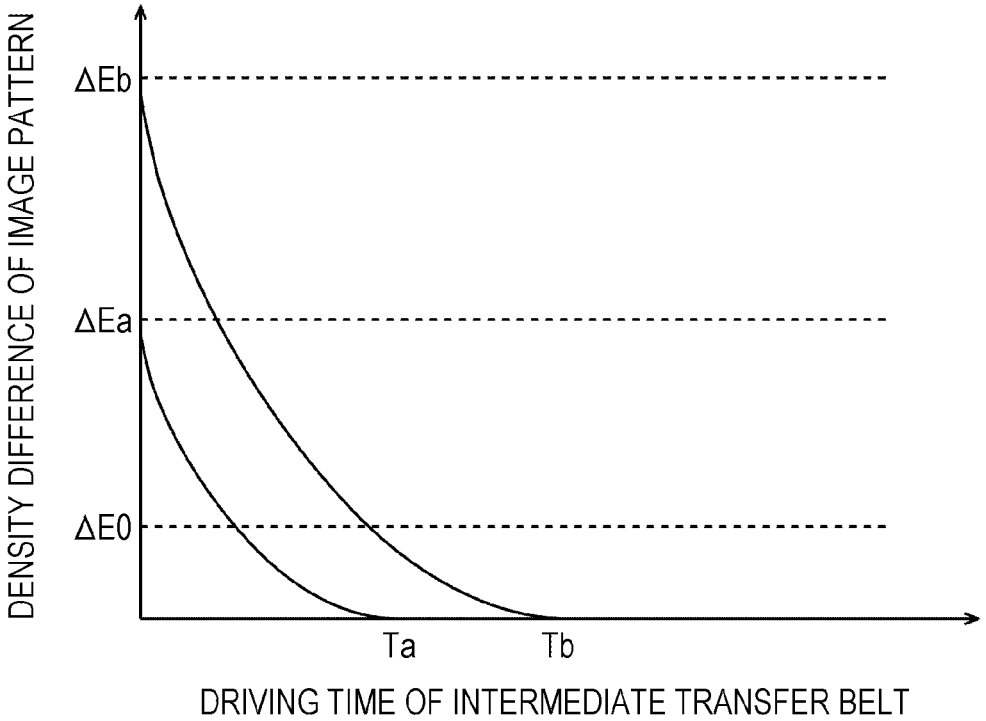
FIG. 12 is a graph illustrating another example of the relationship between the density difference of the image pattern and the driving time of the intermediate transfer belt according to a first modification example.
FIG. 13 is a table illustrating the relationship between the density difference of the image pattern and the driving time of the intermediate transfer belt according to the first modification example.

FIG. 12 is a graph illustrating another example of the relationship between the density difference of the image pattern and the driving time of the intermediate transfer belt according to a first modification example. FIG. 13 is a table illustrating the relationship between the density difference of the image pattern and the driving time of the intermediate transfer belt according to the first modification example Referring to FIGS. 12 and 13, in the present example, a first density threshold value ΔE0, a second density threshold value ΔEa, and a third density threshold value ΔEb are provided. The third density threshold ΔEb is higher than the second density threshold ΔEa, and the second density threshold ΔEa is higher than the first density threshold ΔE0.

In a case in which the density difference ΔE of the image pattern GP is equal to or lower than the first density threshold value ΔE0, it is unknown whether or not the density difference ΔE is caused by the bleed. In this case, no driving time of the intermediate transfer belt 57 is set. In a case in which the density difference ΔE of the image pattern GP is higher than the first density threshold value ΔE0 and equal to or lower than the second density threshold value ΔEa, the driving time is set to Ta. In a case in which the density difference ΔE of the image pattern GP is higher than the second density threshold value ΔEa and equal to or lower than the third density threshold value ΔEb, the driving time is set to Tb, which is longer than Ta.

The relationship between the density difference ΔE of the image pattern GP and the driving time of the intermediate transfer belt 57 may be stored in advance in the HDD 115 or the like as a table as illustrated in FIG. 12. Alternatively, a mathematical formula expressing the relationship between the density difference ΔE of the image pattern GP and the driving time of the intermediate transfer belt 57 may be stored in advance in the HDD 115 or the like.

Figure 14:
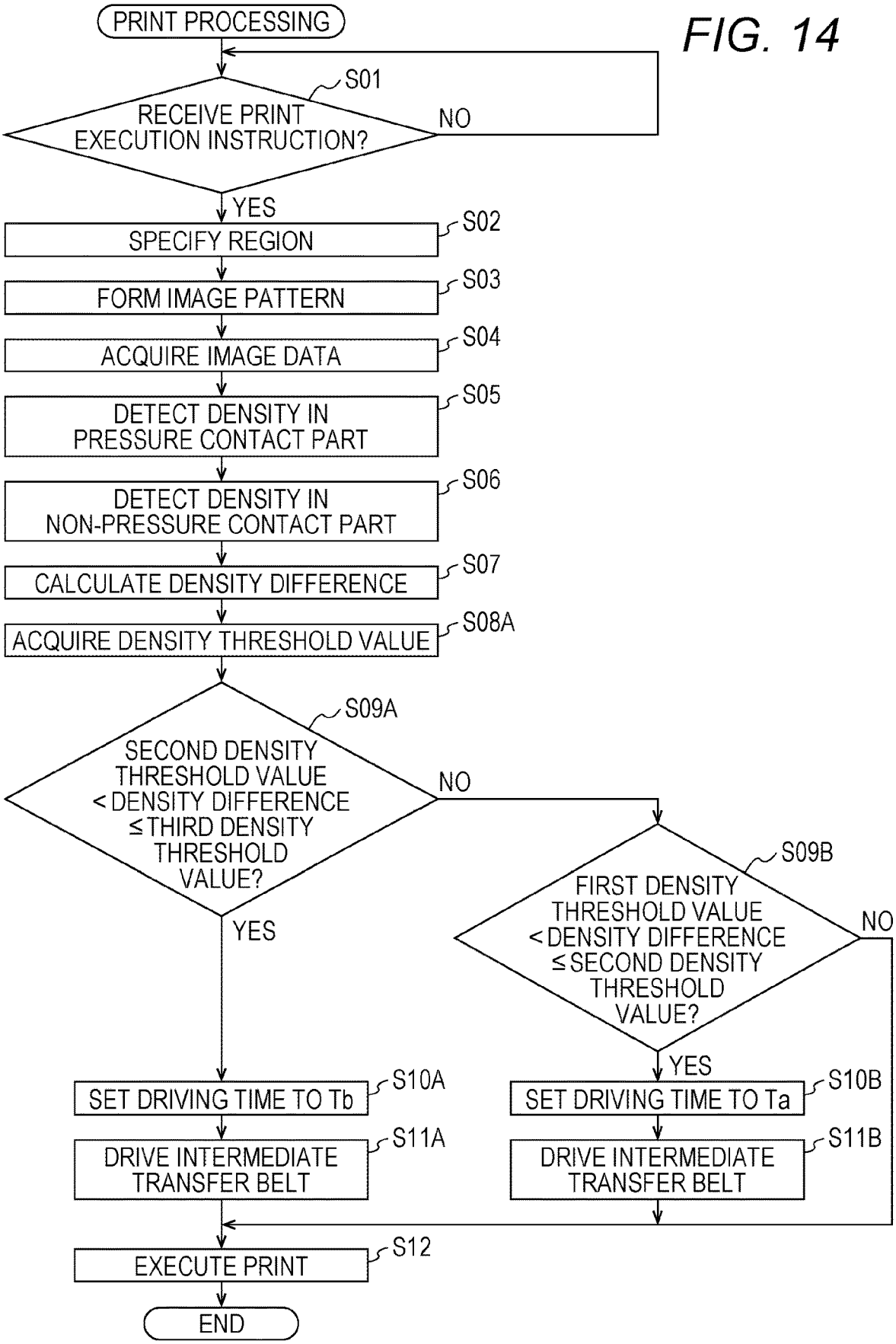
FIG. 14 is a flowchart illustrating an example of a flow of print processing according to the first modification example.

FIG. 14 is a flowchart illustrating an example of a flow of print processing according to the first modification example. The print processing in FIG. 14 is similar to the print processing in FIG. 11 except that step S08 is changed to step S08A, step S09 is changed to steps S09A and S09B, step S10 is changed to steps S10A and S10B, and step S11 is changed to steps S11A and S11B. Since the other steps are equal to those illustrated in FIG. 11, the description thereof will not be repeated here.

In step S08A, the first density threshold value ΔE0, the second density threshold value ΔEa, and the third density threshold value ΔEb are acquired, and the processing proceeds to step S09A. In step S09A, it is determined whether or not the density difference ΔE of the image pattern GP is higher than the second density threshold value ΔEa and equal to or lower than the third density threshold value ΔEb. In a case in which the density difference ΔE of the image pattern GP is higher than the second density threshold value ΔEa and equal to or lower than the third density threshold value ΔEb, the processing proceeds to step S10A, and otherwise, the processing proceeds to step S09B.

In step S09B, it is determined whether or not the density difference ΔE of the image pattern GP is higher than the first density threshold value ΔE0 and equal to or lower than the second density threshold value ΔEa. In a case in which the density difference ΔE of the image pattern GP is higher than the first density threshold value ΔE0 and is equal to or lower than the second density threshold value ΔEa, the processing proceeds to step S10B, and otherwise (in a case in which the density difference ΔE is equal to or lower than the first density threshold value ΔE0), the processing proceeds to step S12.

In step S10A, the driving time of the intermediate transfer belt 57 is set to Tb, and the processing proceeds to step S11A. In step S11A, the intermediate transfer belt 57 is driven for the set driving time Tb, and the processing proceeds to step S12. In step S10B, the driving time of the intermediate transfer belt 57 is set to Ta, and the processing proceeds to step S11B. In step S11B, the intermediate transfer belt 57 is driven for the set driving time Ta, and the processing proceeds to step S12. According to the present example, since the driving time is determined in accordance with the degree of contamination of the pressure contact part 57A of the intermediate transfer belt 57, foreign matters can efficiently be removed from the intermediate transfer belt 57.

Second Modification Example

In a case in which the density difference ΔE of the image pattern GP is high, such as a case in which the degree of contamination of the pressure contact part 57A is high, the bleed adhering to the pressure contact part 57A cannot completely be removed even in a case in which the intermediate transfer belt 57 is driven for a predetermined time T in some cases. Therefore, the driving of the intermediate transfer belt 57 may be repeated until the degree of contamination of the pressure contact part 57A is equal to or lower than an allowable value.

Figure 15:
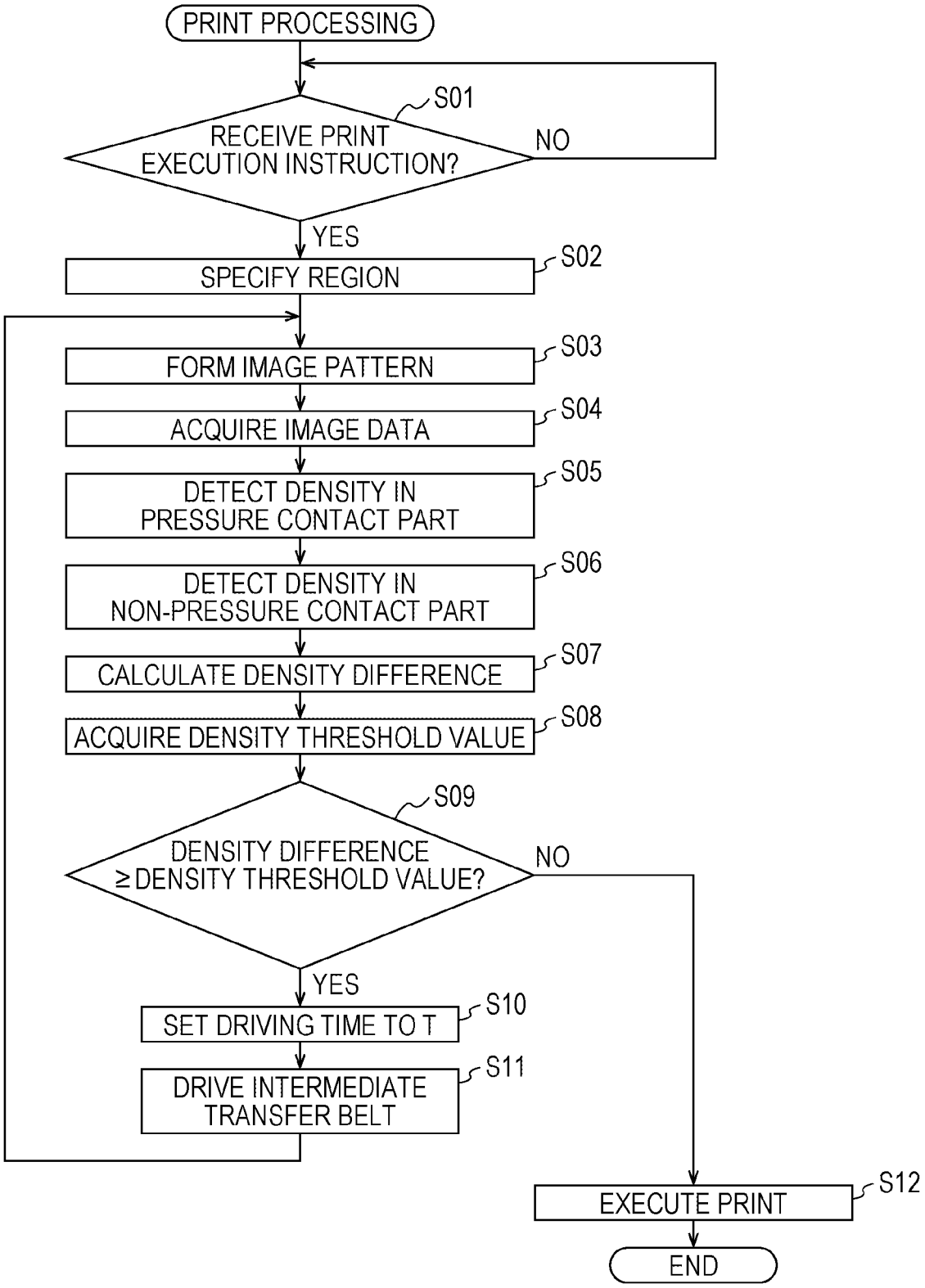
FIG. 15 is a flowchart illustrating an example of a flow of print processing according to a second modification example.

FIG. 15 is a flowchart illustrating an example of a flow of print processing according to a second modification example. The print processing in FIG. 15 is similar to the print processing in FIG. 11 except that the processing in step S11 differs. Since the other steps are equal to those illustrated in FIG. 11, the description thereof will not be repeated here. The print processing in the present example may be combined with the print processing according to the first modification example.

In step S11, the intermediate transfer belt 57 is driven for the set driving time T, and the processing proceeds to step S03 instead of step S12. In this case, steps S03 to S09 are executed again. Steps S03 to S11 are repeated until it is determined in step S09 that the density difference ΔE of the image pattern GP is lower than the density threshold value, that is, until it is determined that the degree of contamination is equal to or lower than the allowable value. This can more reliably prevent the pressure contact part 57A from being contaminated due to the bleed.

Third Modification Example

The amount of the bleed component contained in the secondary transfer roller 47 is larger as the secondary transfer roller 47 is newer and decreases further as the secondary transfer roller 47 is used more. Therefore, the newer the secondary transfer roller 47, the more likely it is that the pressure contact part 57A will be contaminated by the bleed. Therefore, in a case in which the secondary transfer roller 47 has a certain number of pieces of processing, processing for removing the bleed (hereinbelow referred to as removal processing) may not be performed. The number of pieces of processing of the secondary transfer roller 47 is the total number of recording media that have passed between the secondary transfer roller 47 and the intermediate transfer belt 57, for example.

FIG. 16 is a table illustrating the relationship between the number of pieces of processing of the secondary transfer roller and the removal processing according to a third modification example. Referring to FIG. 16, in a case in which the number of pieces of processing of the secondary transfer roller 47 is smaller than a predetermined processing threshold value (10000 in the present example), the removal processing is executed. On the other hand, in a case in which the number of pieces of processing of the secondary transfer roller 47 is equal to or larger than the processing threshold value, the removal processing is not executed. The table in FIG. 16 is stored in the HDD 115, for example. In the present example, although the processing threshold value is 10000, other values may be used. The processing threshold value is a value obtained by experiments in consideration of the influence of the number of pieces of processing of the secondary transfer roller 47 on the image quality.

Figure 17:
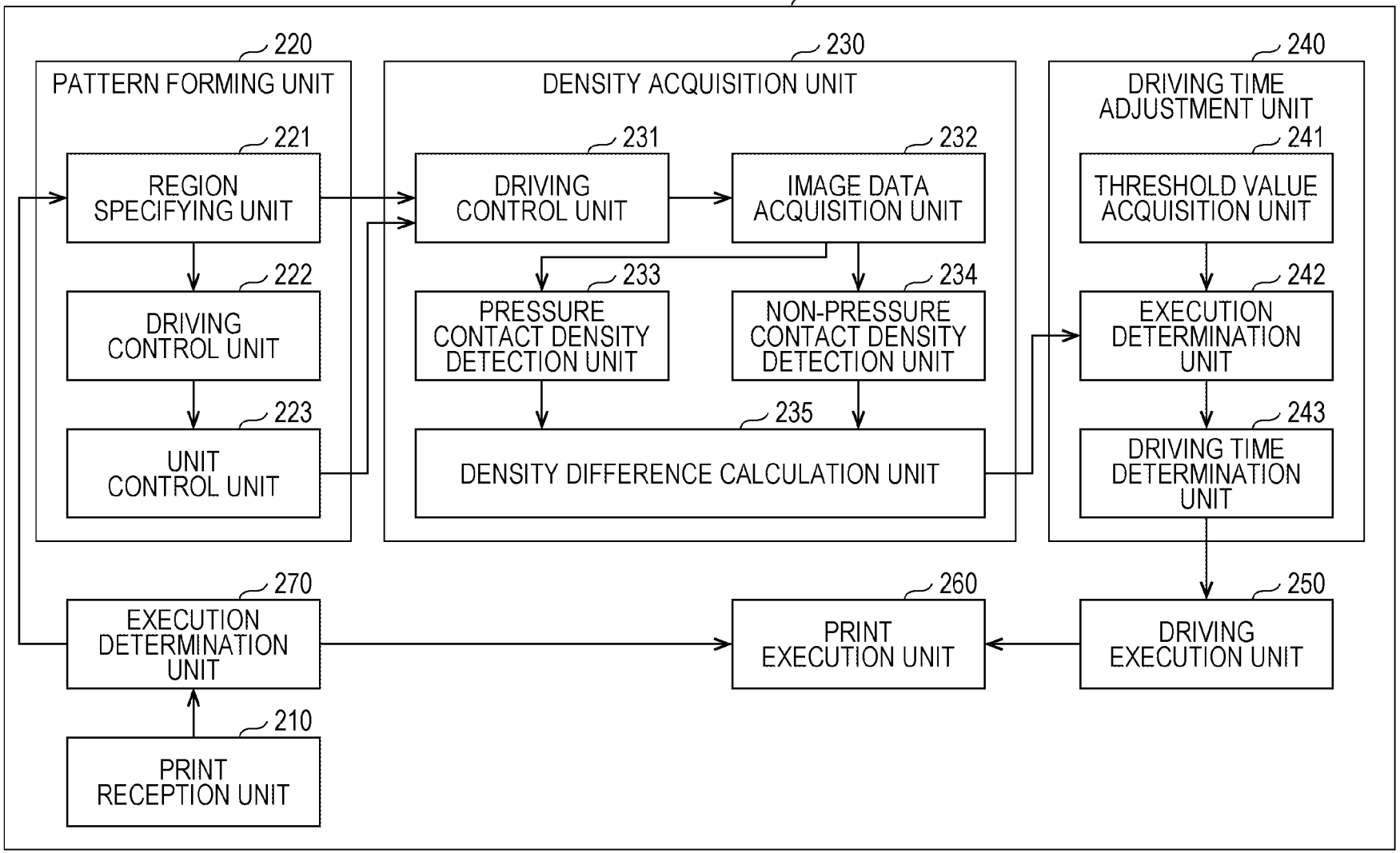
FIG. 17 is a diagram illustrating an example of functions of the CPU in the MFP according to the third modification example.

FIG. 17 is a diagram illustrating an example of the functions of the CPU in the MFP according to the third modification example Referring to FIG. 17, the difference from the functions illustrated in FIG. 10 is that the CPU 111 further includes an execution determination unit 270. Since the other functions are equal to those illustrated in FIG. 10, the description thereof will not be repeated here. The execution determination unit 270 determines whether or not to execute the removal processing based on the current number of pieces of processing of the secondary transfer roller 47 and the table in FIG. 16 in response to the print reception unit 210 receiving the instruction to execute print. In a case in which it is determined by the execution determination unit 270 that the removal processing is to be executed, the region specifying unit 221 of the pattern forming unit 220 performs a similar operation to that of the region specifying unit 221 in FIG. 10. In a case in which it is determined by the execution determination unit 270 that the removal processing is not to be executed, the print execution unit 260 executes print on the recording medium.

Figure 18:
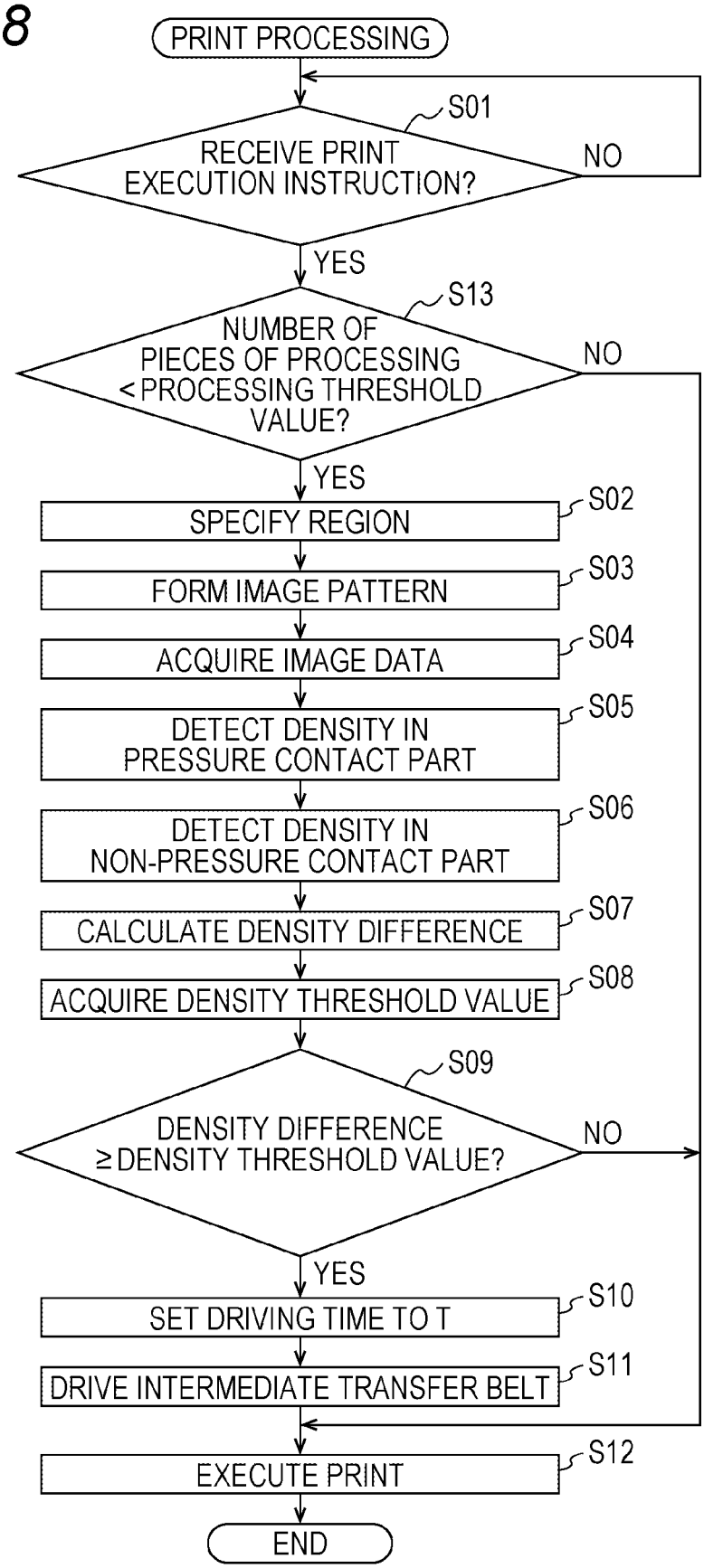
FIG. 18 is a flowchart illustrating an example of a flow of print processing according to the third modification example.

FIG. 18 is a flowchart illustrating an example of a flow of print processing according to the third modification example. The print processing in FIG. 18 is similar to the print processing in FIG. 11 except that step S13 is added. Since the other steps are equal to those illustrated in FIG. 11, the description thereof will not be repeated here. The print processing in the present example may be combined with the print processing according to the first or second modification example.

In a case of YES in step S01, the processing proceeds to step S13 instead of step S02. In step S13, it is determined whether or not the number of pieces of processing of the secondary transfer roller 47 is smaller than the processing threshold value. In a case in which the number of pieces of processing of the secondary transfer roller 47 is smaller than the processing threshold value, the processing proceeds to step S02, and otherwise, the processing proceeds to step S12.

In this case, print is executed without execution of the removal processing in steps S02 to S11. As a result, delay in image formation on the recording medium and a decrease in productivity can be prevented, and the printing processing can be executed at high speed. Also, since it is not necessary to form the image pattern GP, the toner consumption can be reduced.

Fourth Modification Example

The longer the operation stop time of the intermediate transfer belt 57, the more likely it is that the pressure contact part 57A is contaminated by the bleed. Therefore, in a case in which the operation stop time of the intermediate transfer belt 57 is short, the contamination of the pressure contact part 57A by the bleed has a small effect on the image quality of the image formed on the recording medium, and thus the removal processing does not have to be performed.

FIG. 19 is a table illustrating the relationship between the operation stop time of the intermediate transfer belt and the removal processing in a fourth modification example. Referring to FIG. 19, in a case in which the operation stop time of the intermediate transfer belt 57 is shorter than a predetermined time threshold value (72 hours in the present example), the removal processing is not executed. On the other hand, in a case in which the operation stop time of the intermediate transfer belt 57 is equal to or longer than the time threshold value, the removal processing is executed. The table in FIG. 19 is stored in the HDD 115, for example. In the present example, although the time threshold value is 72 hours, other values may be used. The time threshold value is a value obtained by experiments in consideration of the influence of the operation stop time of the intermediate transfer belt 57 (the pressure contact time between the intermediate transfer belt 57 and the secondary transfer roller 47) on the image quality.

The function of the HDD 115 in the MFP 100 in the present modification example is similar to the function of the HDD 115 in the MFP 100 in the third modification example in FIG. 17. The execution determination unit 270 in the present example determines whether or not to execute the removal processing based on the operation stop time of the intermediate transfer belt 57 and the table in FIG. 19. In a case in which it is determined by the execution determination unit 270 that the removal processing is to be executed, the region specifying unit 221 performs a similar operation to that of the region specifying unit 221 in FIG. 10. In a case in which it is determined by the execution determination unit 270 that the removal processing is not to be executed, the print execution unit 260 executes print on the recording medium.

Figure 20:
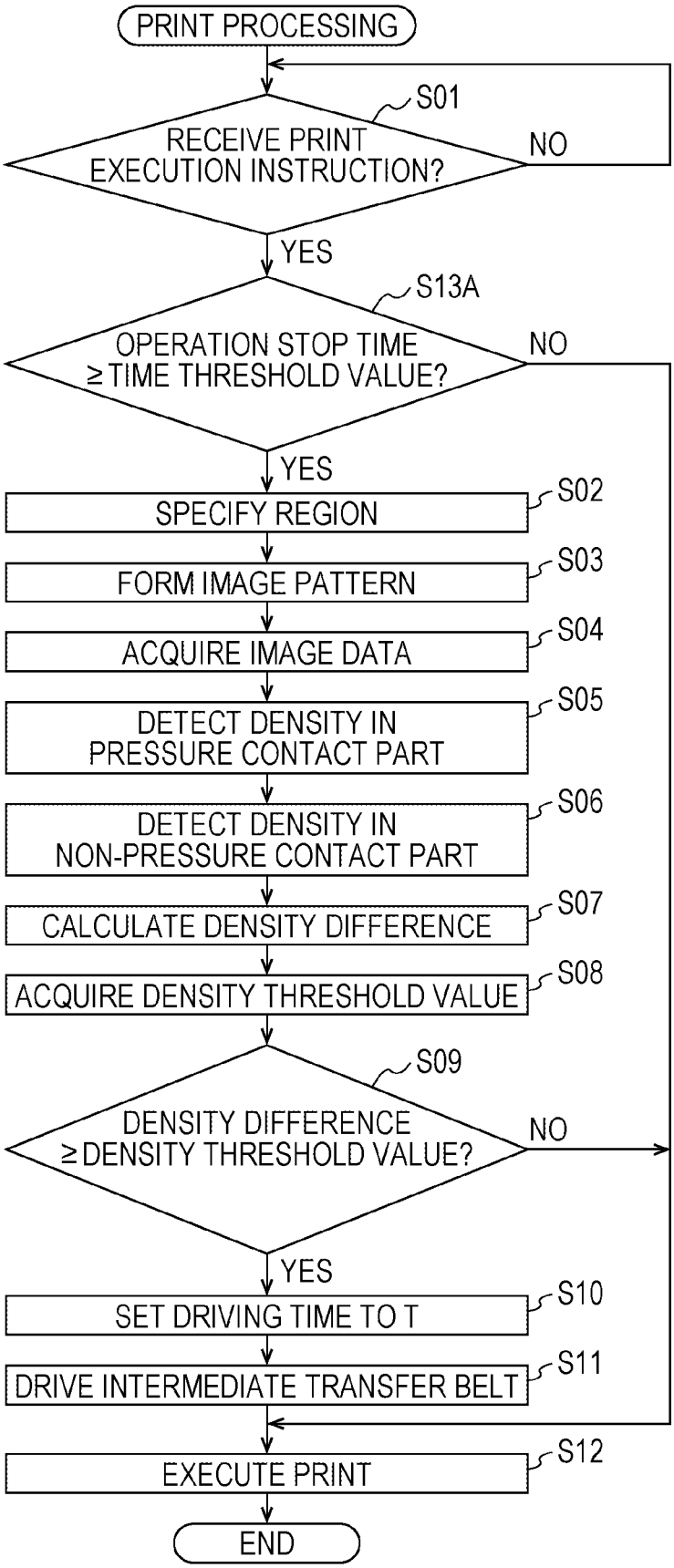
FIG. 20 is a flowchart illustrating an example of a flow of print processing according to the fourth modification example.

FIG. 20 is a flowchart illustrating an example of a flow of print processing according to the fourth modification example. The print processing in FIG. 20 is similar to the print processing in FIG. 18 except that step S13 is changed to step S13A. Since the other steps are equal to those illustrated in FIG. 18, the description thereof will not be repeated here. The print processing in the present example may be combined with the print processing according to the first to third modification examples.

In a case of YES in step S01, the processing proceeds to step S13A instead of step S02. In step S13A, it is determined whether or not the operation stop time of the intermediate transfer belt 57 is equal to or longer than the time threshold value. In a case in which the operation stop time of the intermediate transfer belt 57 is equal to or longer than the time threshold value, the processing proceeds to step S02, and otherwise, the processing proceeds to step S12.

In this case, print is executed without execution of the removal processing in steps S02 to S11. As a result, delay in image formation on the recording medium and a decrease in productivity can be prevented, and the printing processing can be executed at high speed. Also, since it is not necessary to form the image pattern GP, the toner consumption can be reduced.

As described above, the print processing according to the present example may be combined with the print processing according to the third modification example. Here, even in a case in which the secondary transfer roller 47 is new, and in a case in which the operation stop time of the intermediate transfer belt 57 is short, there is a case in which the contamination of the pressure contact part 57A by the bleed has a small effect on the image quality of the image formed on the recording medium. On the other hand, even in a case in which the secondary transfer roller 47 is old, and in a case in which the operation stop time of the intermediate transfer belt 57 is long, there is a case in which the contamination of the pressure contact part 57A by the bleed has a large effect on the image quality of the image formed on the recording medium. Therefore, in a case in which the print processing according to the third modification example and the print processing according to the fourth modification example are combined, whether or not the removal processing is executed is determined in accordance with the combination of the number of pieces of processing of the secondary transfer roller 47 with the operation stop time of the intermediate transfer belt 57.

FIG. 21 is a table illustrating the relationship among the number of pieces of processing of the secondary transfer roller, the operation stop time of the intermediate transfer belt, and the removal processing. Referring to FIG. 21, in a case in which the number of pieces of processing of the secondary transfer roller 47 is smaller than a predetermined processing threshold value (10000 in the present example), and in which the operation stop time of the intermediate transfer belt 57 is shorter than a predetermined first time threshold value (72 hours in the present example), the removal processing is not executed. In a case in which the number of pieces of processing of the secondary transfer roller 47 is smaller than the processing threshold value, and in which the operation stop time of the intermediate transfer belt 57 is equal to or longer than the first time threshold value, the removal processing is executed.

In a case in which the number of pieces of processing of the secondary transfer roller 47 is equal to or larger than the processing threshold value, and in which the operation stop time of the intermediate transfer belt 57 is shorter than a predetermined second time threshold value (168 hours in the present example), the removal processing is not executed. In a case in which the number of pieces of processing of the secondary transfer roller 47 is equal to or larger than the processing threshold value, and in which the operation stop time of the intermediate transfer belt 57 is equal to or longer than the second time threshold value, the removal processing is executed. In the example in FIG. 21, although the processing threshold value is 10000, the first time threshold value is 72 hours, and the second time threshold value is 168 hours, these threshold values may be other values. The execution determination unit 270 determines whether or not to execute the removal processing based on the current number of pieces of processing of the secondary transfer roller 47, the current operation stop time of the intermediate transfer belt 57, and the table in FIG. 21.

As described above, the MFP 100 according to the first embodiment functions as an image forming apparatus, the intermediate transfer belt 57 and the secondary transfer roller 47 are in pressure contact with each other, and the cleaning blade 59 is in contact with the intermediate transfer belt 57 to remove toner remaining on the intermediate transfer belt 57. In the MFP 100, an image pattern GP is formed in a region including at least a part of the pressure contact part 57A that is in pressure contact with the secondary transfer roller 47 when the operation of the intermediate transfer belt 57 is stopped, density of the image pattern GP is acquired, driving time of the intermediate transfer belt 57 is adjusted based on the density of the image pattern, and the intermediate transfer belt 57 is driven for the driving time adjusted at a stage before an image is formed on a recording medium. Therefore, since the density of the image pattern in the pressure contact part 57A differs depending on the degree of contamination of the pressure contact part 57A of the intermediate transfer belt 57 due to bleed of the secondary transfer roller 47, the driving time of the intermediate transfer belt 57 is adjusted in accordance with the degree of contamination of the pressure contact part 57A. Therefore, foreign matters including bleed adhering to the pressure contact part 57A are removed by the cleaning blade 59. This can prevent the quality of the image formed on the recording medium from being lowered.

Preferably, the image pattern GP is formed in a region including at least the part of the pressure contact part 57A and at least a part of the non-pressure contact part 57B, and the driving time of the intermediate transfer belt 57 is adjusted based on distribution of the density of the image pattern GP acquired. Therefore, the degree of contamination of the pressure contact part 57A can be detected easily.

Preferably, a density difference between the image pattern GP formed in at least the part of the pressure contact part 57A and the image pattern GP formed in at least the part of the non-pressure contact part 57B of the intermediate transfer belt 57 is acquired as the distribution of the density of the image pattern GP. Therefore, the degree of contamination of the pressure contact part 57A can be detected accurately.

Preferably, a density difference between a maximum density value and a minimum density value in the image pattern GP is acquired as the distribution of the density of the image pattern GP. Therefore, the degree of contamination of the pressure contact part 57A can be detected easily.

Preferably, the image pattern GP is formed in at least the part of the pressure contact part 57A and at least the part of the non-pressure contact part 57B so as to bridge over the pressure contact part 57A in a front-rear direction in a driving direction of the intermediate transfer belt 57. Therefore, the density difference of the image pattern GP can be obtained more easily since, in a case in which the pressure contact part 57A is contaminated, the density of the image pattern GP in the pressure contact part 57A and that in the non-pressure contact part 57B located at the front and rear of the pressure contact part 57A differ significantly.

Preferably, the image pattern GP is formed in a region in which at least the part of the pressure contact part 57A and at least the part of the non-pressure contact part 57B are continuous. Therefore, the density difference of the image pattern GP can be obtained more easily since, in a case in which the pressure contact part 57A is contaminated, the density of the image pattern GP differs significantly at a boundary portion between the pressure contact part 57A and the non-pressure contact part 57B.

Preferably, the driving time of the intermediate transfer belt 57 is extended so that the driving time is longer as the density difference is higher. Therefore, since the driving time is determined in accordance with the degree of contamination of the pressure contact part 57A of the intermediate transfer belt 57, foreign matters can efficiently be removed from the intermediate transfer belt 57.

Preferably, after driving of the intermediate transfer belt 57 is executed, operation is repeated until the density difference is equal to or lower than a predetermined allowable value. Therefore, foreign matters adhering to the pressure contact part 57A can be removed reliably.

Preferably, the image pattern GP is formed in a case in which the number of pieces of processing of the secondary transfer roller 47 is equal to or smaller than a predetermined value. Therefore, in a case in which the number of pieces of processing of the secondary transfer roller 47 exceeds the predetermined value, it is considered that the contamination of the pressure contact part 57A of the intermediate transfer belt 57 has a small effect on the image quality of the image formed on the recording medium, and a series of operations to remove foreign matters in the pressure contact part 57A is not performed. In this case, since the intermediate transfer belt 57 is not driven, delay in image formation on the recording medium and a decrease in productivity can be prevented.

Preferably, the image pattern GP is formed in a case in which operation stop time of the intermediate transfer belt 57 is equal to or longer than a predetermined value. Therefore, in a case in which the operation stop time of the intermediate transfer belt 57 is shorter than the predetermined value, it is considered that the contamination of the pressure contact part 57A of the intermediate transfer belt 57 has a small effect on the image quality of the image formed on the recording medium, and a series of operations to remove foreign matters in the pressure contact part 57A is not performed. In this case, since the intermediate transfer belt 57 is not driven, delay in image formation on the recording medium and a decrease in productivity can be prevented.

Second Embodiment

Figure 22:
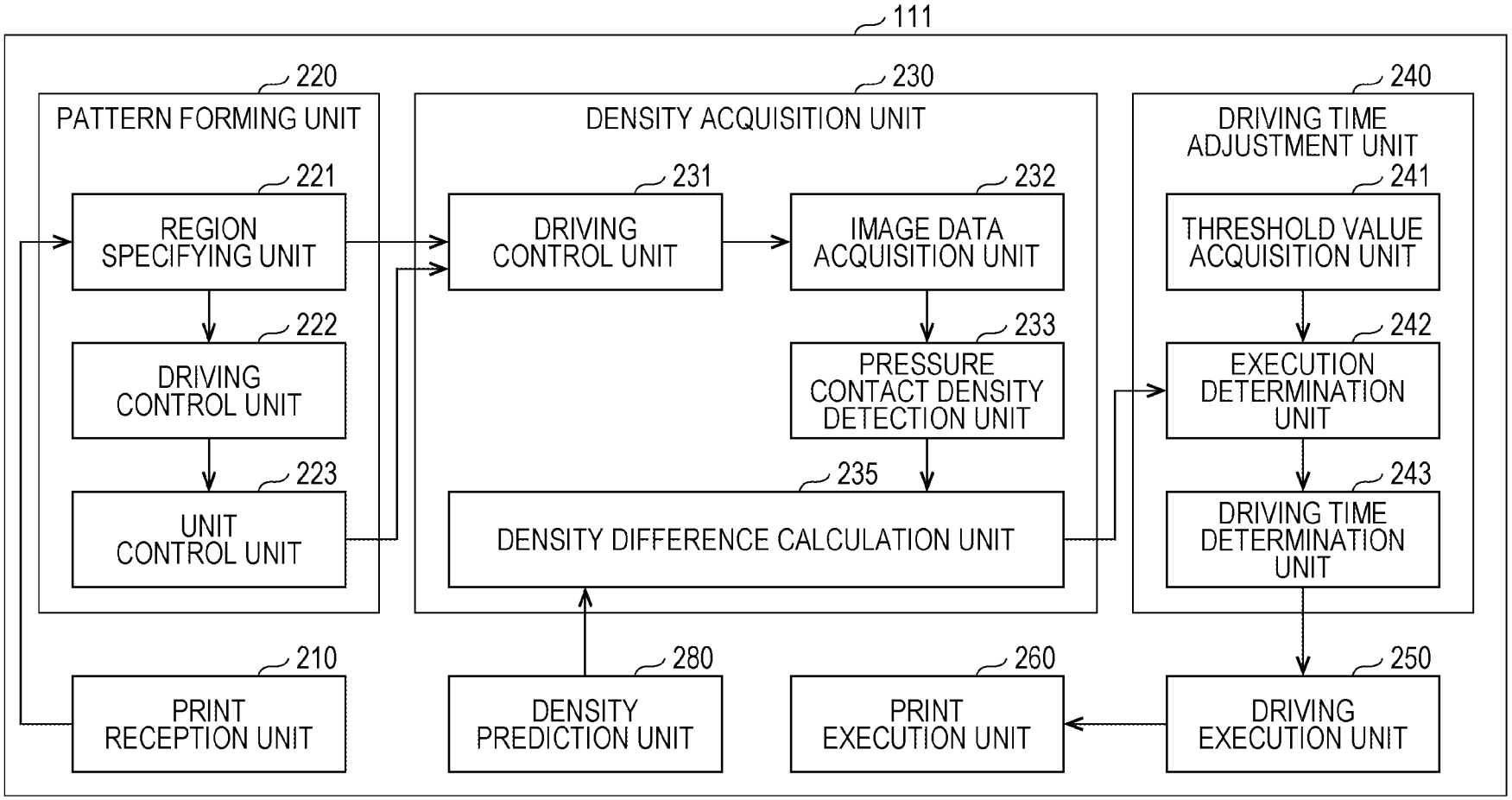
FIG. 22 is a diagram illustrating an example of functions of the CPU in the MFP according to a second embodiment.

The appearance of the MFP 100 according to a second embodiment is the same as that illustrated in FIG. 1. Also, the hardware configuration of the MFP 100 according to the second embodiment is the same as that illustrated in FIG. 2. FIG. 22 is a diagram illustrating an example of the functions of the CPU in the MFP according to the second embodiment. Referring to FIG. 22, the difference from the functions illustrated in FIG. 10 is that the CPU 111 further includes a density prediction unit 280 and that the density acquisition unit 230 does not include the non-pressure contact density detection unit 234. Since the other functions are equal to those illustrated in FIG. 10, the description thereof will not be repeated here.

The region specifying unit 221 specifies a region in the pressure contact part 57A in which the image pattern GP is to be formed in response to the print reception unit 210 receiving an instruction to execute print. In this case, an image pattern GP having predetermined density is formed in the region including at least a part of the pressure contact part 57A specified by the region specifying unit 221.

The density prediction unit 280 acquires as predicted density the density of an image pattern GP formed on the intermediate transfer belt 57 by the pattern forming unit 220 in a state in which the intermediate transfer belt 57 is not contaminated. The predicted density may be obtained by an arithmetic expression using a control value obtained by image stabilization processing. Also, in consideration of deterioration of the image former 140 with time, the predicted density may be a value measured with respect to the cumulative driving time of the image former 140 by experiments or the like. The density difference calculation unit 235 calculates a difference between the density detected by the pressure contact density detection unit 233 and the predicted density acquired by the density prediction unit 280. As a result, the density difference ΔE of the image pattern GP is acquired. In this case, the driving time of the intermediate transfer belt 57 is adjusted by the driving time adjustment unit 240 based on the density difference ΔE of the image pattern GP.

Figure 23:
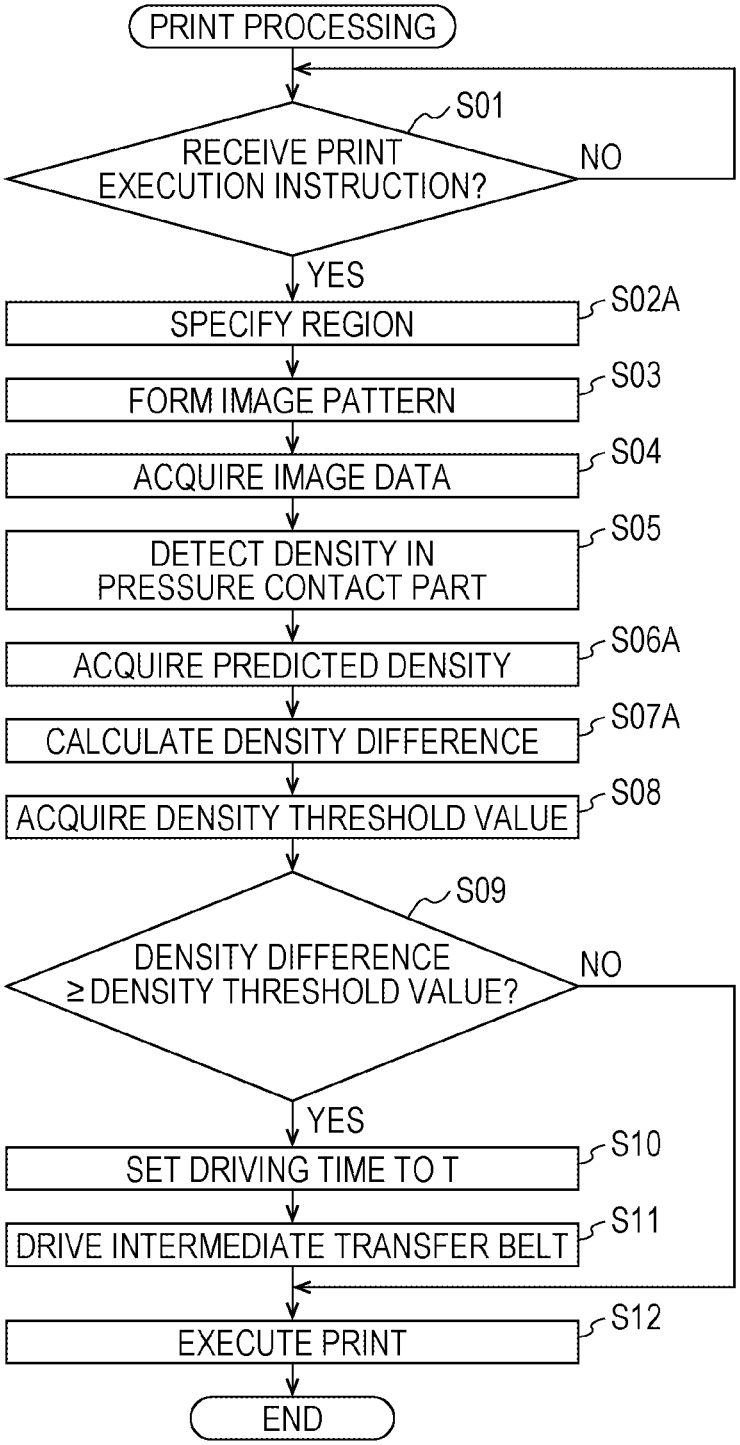
FIG. 23 is a flowchart illustrating an example of a flow of print processing according to the second embodiment.

FIG. 23 is a flowchart illustrating an example of a flow of print processing according to the second embodiment. The print processing in FIG. 23 is similar to the print processing in FIG. 11 except that step S02 is changed to step S02A, step S06 is changed to step S06A, and step S07 is changed to steps S07A. Since the other steps are equal to those illustrated in FIG. 11, the description thereof will not be repeated here. Note that the first to fourth modification examples of the first embodiment can also be applied to the printing processing illustrated in FIG. 23.

In step S02A, a region including at least a part of the pressure contact part 57A of the intermediate transfer belt 57 is specified as a region in which the image pattern GP is to be formed, and the processing proceeds to step S03. In step S06A, predetermined density of the image pattern GP is acquired as predicted density, and the processing proceeds to step S07A. In step S07A, a difference between the density of the image pattern GP in the pressure contact part 57A and the predicted density is calculated as the density difference ΔE of the image pattern GP, and the processing proceeds to step S08.

According to the present embodiment, contamination of the pressure contact part 57A by bleed can be detected without forming an image pattern GP in the non-pressure contact part 57B. Therefore, the amount of toner consumed for forming the image pattern GP can be reduced.

In the MFP 100 according to the second embodiment, density of an image pattern GP formed on the intermediate transfer belt 57 is predicted, and based on a density difference between the density of the image pattern GP predicted and the density of the image pattern GP acquired, driving time of an image carrier is adjusted. Therefore, since the image pattern GP is formed in the pressure contact part 57A of the intermediate transfer belt 57, the amount of toner consumed for forming the image pattern GP can be reduced.

Other Embodiments

In the first or second embodiment, the image former 140 employs an intermediate transfer method and may employ a direct transfer method. Further, although the image carrier is the intermediate transfer belt 57, and the elastic body is the secondary transfer roller 47, each of the embodiments is not limited to this. The elastic body may be the cleaning blade 59. Alternatively, the image carrier may be the photoconductor drums 53Y, 53M, 53C, and 53K. In this case, the elastic body may be the charging rollers 54Y, 54M, 54C, and 54K. Alternatively, in a case in which the image former 140 employs the direct transfer method, the elastic body may be the transfer rollers that are in pressure contact with the photoconductor drums.

APPENDIX

Preferably, the image forming apparatus further includes a first image carrier (photoconductor drum) that carries a toner image formed by toner, and a second image carrier (intermediate transfer belt) to which the toner image carried on the first image carrier is transferred and that carries the toner image transferred, in which the elastic body transfers the toner image carried on the second image carrier to a recording medium.

Preferably, the image carrier carries the toner image formed by toner, the elastic body causes the image carrier to be charged, and the image carrier carries the toner image as an electrostatic latent image formed as the image carrier is exposed after being charged is developed.

Although embodiments of the present disclosure have been described and illustrated in detail, the disclosed embodiments are made for purposes of illustration and example only and not limitation. The scope of the present disclosure should be interpreted by terms of the appended claims rather than by terms of the above description, and it is intended that all modifications are included within the meaning and scope equivalent to the patent claims.

As used herein, the words "can" and "may" are used in a permissive (i.e., meaning having the potential to), rather than mandatory sense (i.e., meaning must). The words "include," "includes," "including," and the like mean including, but not limited to. Similarly, the singular form of "a" and "the" include plural references unless the context clearly dictates otherwise. And the term "number" shall mean one or an integer greater than one (i.e., a plurality).

What is claimed is:

1. An image forming apparatus in which an image carrier and an elastic body are in pressure contact with each other, and in which a toner remover is in contact with the image carrier to remove toner remaining on the image carrier, the image forming apparatus comprising:

a first hardware processor that forms an image pattern in a region including at least a part of a pressure contact part of the image carrier that is in pressure contact with the elastic body, when operation of the image carrier is stopped;

a second hardware processor that acquires density of the image pattern formed on the image carrier by the first hardware processor;

a third hardware processor that adjusts driving time of the image carrier based on the density of the image pattern acquired by the second hardware processor; and a fourth hardware processor that drives the image carrier for the driving time adjusted by the third hardware processor at a stage before an image is formed on a recording medium.

2. The image forming apparatus according to claim 1, wherein the first hardware processor forms the image pattern in a region including at least the part of the pressure contact part and at least a part of a non-pressure contact part of the image carrier that is not in pressure contact with the elastic body, when the operation of the image carrier is stopped, and wherein the third hardware processor adjusts the driving time of the image carrier based on distribution of the density of the image pattern acquired by the second hardware processor.

3. The image forming apparatus according to claim 2, wherein the second hardware processor acquires a density difference between the image pattern formed in at least the part of the pressure contact part and the image pattern formed in at least the part of the non-pressure contact part of the image carrier as the distribution of the density of the image pattern.

4. The image forming apparatus according to claim 2, wherein the second hardware processor acquires a density difference between a maximum density value and a minimum density value in the image pattern as the distribution of the density of the image pattern.

5. The image forming apparatus according to claim 3, wherein the first hardware processor forms the image pattern in at least the part of the pressure contact part and at least the part of the non-pressure contact part so as to bridge over the pressure contact part in a front-rear direction in a driving direction of the image carrier.

6. The image forming apparatus according to claim 3, wherein the first hardware processor forms the image pattern in a region in which at least the part of the pressure contact part and at least the part of the non-pressure contact part are continuous.

7. The image forming apparatus according to claim 3, wherein the third hardware processor extends the driving time of the image carrier so that the driving time is longer as the density difference is higher.

8. The image forming apparatus according to claim 3, wherein, after driving of the image carrier is executed by the fourth hardware processor, the first hardware processor repeats operation until the density difference is equal to or lower than a predetermined allowable value.

9. The image forming apparatus according to claim 1, further comprising a fifth hardware processor that predicts density of the image pattern formed on the image carrier by the first hardware processor, wherein the third hardware processor adjusts the driving time of the image carrier based on a density difference between the density of the image pattern predicted by the fifth hardware processor and the density of the image pattern acquired by the second hardware processor.

10. The image forming apparatus according to claim 1, wherein the first hardware processor is operated in a case in which the number of pieces of processing of the elastic body is equal to or smaller than a predetermined value.

11. The image forming apparatus according to claim 1, wherein the first hardware processor is operated in a case in which operation stop time of the image carrier is equal to or longer than a predetermined value.

12. An image forming method executed in an image forming apparatus in which an image carrier and an elastic body are in pressure contact with each other, and in which a toner remover is in contact with the image carrier to remove toner remaining on the image carrier, the image forming method comprising:

forming an image pattern in a region including at least a part of a pressure contact part of the image carrier that is in pressure contact with the elastic body, when operation of the image carrier is stopped;

acquiring density of the image pattern formed on the image carrier;

adjusting driving time of the image carrier based on the density of the image pattern acquired; and driving the image carrier for the driving time adjusted at a stage, before an image is formed on a recording medium.

13. A non-transitory recording medium storing a computer readable image forming program causing a computer, controlling an image forming apparatus in which an image carrier and an elastic body are in pressure contact with each other, and in which a toner remover is in contact with the image carrier to remove toner remaining on the image carrier, to perform:

forming an image pattern in a region including at least a part of a pressure contact part of the image carrier that is in pressure contact with the elastic body, when operation of the image carrier is stopped;

acquiring density of the image pattern formed on the image carrier;

adjusting driving time of the image carrier based on the density of the image pattern acquired; and driving the image carrier for the driving time adjusted at a stage, before an image is formed on a recording medium.

* * * * *